US011214943B2

(12) United States Patent
Yamanobe et al.

(10) Patent No.: US 11,214,943 B2
(45) Date of Patent: Jan. 4, 2022

(54) WORK MACHINE

(71) Applicant: HITACHI CONSTRUCTION MACHINERY CO., LTD., Tokyo (JP)

(72) Inventors: Yousuke Yamanobe, Ushiku (JP); Kazunori Hoshino, Tsukuba (JP); Satoshi Nakamura, Hitachinaka (JP); Youhei Toriyama, Kashiwa-ku (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 294 days.

(21) Appl. No.: 16/493,488

(22) PCT Filed: Aug. 30, 2018

(86) PCT No.: PCT/JP2018/032242
§ 371 (c)(1),
(2) Date: Sep. 12, 2019

(87) PCT Pub. No.: WO2019/049774
PCT Pub. Date: Mar. 14, 2019

(65) Prior Publication Data

US 2020/0232189 A1 Jul. 23, 2020

(30) Foreign Application Priority Data

Sep. 7, 2017 (JP) ..... JP2017-172527

(51) Int. Cl.
*E02F 9/26* (2006.01)
*E02F 3/32* (2006.01)
(Continued)

(52) U.S. Cl.
CPC ..... *E02F 9/26* (2013.01); *E02F 3/32* (2013.01); *E02F 3/425* (2013.01); *E02F 9/24* (2013.01); *E02F 9/264* (2013.01)

(58) Field of Classification Search
CPC ..... E02F 3/32; E02F 3/425; E02F 9/20; E02F 9/24; E02F 9/26; E02F 9/264
See application file for complete search history.

(56) References Cited

U.S. PATENT DOCUMENTS 9,605,994 B2 * 3/2017 Jensen ..... G06Q 40/12
9,938,692 B2 * 4/2018 Shatters ..... E02F 9/26
(Continued)

FOREIGN PATENT DOCUMENTS

JP 06-010378 A 1/1994
JP 3129176 B2 1/2001
(Continued)

OTHER PUBLICATIONS

International Preliminary Report on Patentability received in corresponding International Application No. PCT/JP2018/032242 dated Mar. 19, 2020.
(Continued)

*Primary Examiner* — Tyler J Lee
(74) *Attorney, Agent, or Firm* — Mattingly & Malur, PC

(57) ABSTRACT

A load value W, which is a weight of a transportation target carried by a front work implement 12, is calculated based on a work load of a boom cylinder 16 of the front work implement 12, and on posture information which is information associated with a posture of the front work implement 12. A load threshold T used for determining whether to recalibrate a load measuring system is changed in accordance with a posture index value which is an index associated with the posture of the front work implement 12 and is obtained based on the posture information. Whether to recalibrate the load measuring system is determined based on the load value W and the load threshold T. A determination result is displayed on a display screen 30 to notify an operator of the determination result. In this manner, deterioration of measuring accuracy is more appropriately detectable regardless of variations of a posture of a front work implement of a work machine.

7 Claims, 23 Drawing Sheets

(51) Int. Cl.
*E02F 3/42* (2006.01)
*E02F 9/24* (2006.01)

(56) References Cited

U.S. PATENT DOCUMENTS

| | | | | |
|---|---|---|---|---|
| 10,597,852 | B2 * | 3/2020 | Hori | E02F 9/26 |
| 10,745,889 | B2 * | 8/2020 | Nishimura | E02F 3/32 |
| 2008/0169131 | A1 | 7/2008 | Takeda et al. | |
| 2009/0228394 | A1 | 9/2009 | Mintah et al. | |

FOREIGN PATENT DOCUMENTS

| | | | |
|---|---|---|---|
| JP | 2003-073078 | A | 3/2003 |
| JP | 2008-037562 | A | 2/2008 |
| JP | 2011-516755 | A | 5/2011 |
| JP | 2013-124461 | A | 6/2013 |
| JP | 2014-172581 | A | 9/2014 |
| WO | 2006/098218 | A1 | 9/2006 |

OTHER PUBLICATIONS

International Search Report of PCT/JP2018/032242 dated Oct. 16, 2018.
Korean Office Action received in corresponding Korean Application No. 10-2019-7025997 dated Nov. 2, 2020.

* cited by examiner

TABLE OF WORK ARM TIP POSITION AND LOAD THRESHOLD T

| WORK ARM TIP POSITION x< α | α ≤WORK ARM TIP POSITION x |
|---|---|
| $T_1$ | $T_2$ |

FIG. 13

TABLE OF WORK ARM TIP POSITION, WORK ARM OPERATION VELOCITY, AND LOAD THRESHOLD T

| | WORK ARM TIP POSITION $< \alpha$ | $\alpha \leq$ WORK ARM TIP POSITION |
|---|---|---|
| WORK ARM OPERATION VELOCITY $< \beta$ | $T_{11}$ | $T_{13}$ |
| $\beta \leq$ WORK ARM OPERATION VELOCITY | $T_{12}$ | $T_{14}$ |

WORK MACHINE

TECHNICAL FIELD

The present invention relates to a work machine.

BACKGROUND ART

For example, mine excavating or constructing work includes excavating and loading work for excavating soil by using a work machine equipped with an articulated front work implement or the like, and loading the soil into a truck. It is preferable that the quantity of soil loaded into the truck is the largest possible quantity in view of work efficiency during the excavating and loading work. On the other hand, a maximum load allowed to be carried on the truck is regulated. When soil is loaded in excess of the maximum load, work efficiency may drop as a result of failure or life shortening of the truck.

Accordingly, as a technology relating to a device for measuring a lived load of a truck, Patent Document 1 discloses such a technology, for example, which stores beforehand an unladen calibrated load value ($\alpha$) in a load value calculation section, and computes a deviation $E=x-\alpha$ between $\alpha$ and a load value (x) obtained when an operator operates reset means offsetting and correcting the load value at the time of deviation of the load value from $\alpha$. When E is smaller than an allowable range b, zero point correction is made. When E is larger than the allowable range b, a display for urging recalibration is output without making zero point correction. In addition, as a technology for recognizing a lived load into a truck, Cited Document 2 discloses a device which measures a quantity of soil excavated by a front work implement of a work machine, for example.

PRIOR ART DOCUMENT

Patent Documents

Patent Document 1: Japanese Patent No. 3129176
Patent Document 2: JP-H06-010378-A

SUMMARY OF THE INVENTION

Problem to be Solved by the Invention

Meanwhile, according to the load measuring device of the conventional technology described above, measuring accuracy may be lowered by deterioration of a sensor or a measuring mechanism. Accordingly, use of a device for correcting deviation such that a load in an unladen state becomes zero, or recalibration of a sensor used for load measurement is required, for example. If the load measuring device is continuously used even after deterioration of measuring accuracy, a load quantity of a truck is difficult to accurately recognize. In this case, work efficiency drops. On the other hand, frequent recalibration may increase a maintenance time or expenses, and therefore may lower work efficiency or raise costs. Accordingly, it is important to detect deterioration of measuring accuracy of the load measuring device at an appropriate time, and perform recalibration or the like at that time.

However, the conventional technology described above is optimized for calibration of a load measuring device of a truck, and therefore may cause troubles associated with characteristics of a measuring principle of the load measuring device when applied to a work machine equipped with a front work implement. For example, when a load measuring device of a work machine equipped with a front work implement measures a load based on a torque balance between a torque generated by the front work implement carrying soil itself at a proximal rotation unit of the front work implement and a torque generated by a hydraulic cylinder which drives the proximal rotation unit of the front work implement, an effect of a positional error relatively increases and deteriorates measuring accuracy in such a posture that a distance between the proximal rotation unit of the front work implement and the center of gravity of the soil carried by the front work implement becomes short. Moreover, frictional resistance within the hydraulic cylinder varies in accordance with an operation velocity of the front work implement. In this case, an error of a measurement value may be produced. More specifically, in principle, the load measuring device of the work machine equipped with the front work implement has such a characteristic that measuring accuracy varies in accordance with the posture or the operation of the front work implement. Accordingly, deterioration of measuring accuracy is difficult to appropriately detect by the conventional technology applied to the work machine equipped with the front work implement.

The present invention has been developed in consideration of the aforementioned circumstances. An object of the present invention is to provide a work machine capable of more appropriately detecting deterioration of measuring accuracy regardless of variations of a posture of a front work implement of the work machine.

Means for Solving the Problem

The present application includes a plurality of means for solving the aforementioned problems. An example of the means is a work machine including: a machine body; a front work implement that is an articulated type, is attached to the machine body, and includes a plurality of front members rotatably connected to each other; a plurality of hydraulic actuators that respectively drive the plurality of front members of the front work implement in accordance with operation signals; a load measuring system that includes a work load sensor detecting work loads of the hydraulic actuators, a plurality of posture information sensors detecting posture information that is information associated with respective postures of the plurality of front members and the machine body, and a controller calculating a load value as a weight of a transportation target carried by the front work implement based on detection results obtained by the work load sensor and the posture information sensors; and a display device disposed inside a cab boarded by an operator. The controller is capable of changing a load threshold used for determining whether to recalibrate the load measuring system in accordance with a posture index value that is an index concerning a posture of the front work implement and obtained based on the detection results of the posture information sensors. The controller determines whether to recalibrate the load measuring system based on a calculation result of the load value and the changed load threshold, and displays a determination result on the display device.

Advantages of the Invention

According to the present invention, deterioration of measuring accuracy is more appropriately detectable regardless of variations of a posture of a front work implement of a work machine.

BRIEF DESCRIPTION OF THE DRAWINGS

FIG. 13 is a diagram illustrating an example of a load threshold table set by a load threshold setting section of Embodiment 2, and used for a load threshold changing process performed by a load threshold changing section.

MODES FOR CARRYING OUT THE INVENTION

Embodiments of the present invention will be hereinafter described with reference to the drawings.

Embodiment 1

Embodiment 1 of the present invention will be described with reference to FIGS. 1 to 11.

Figure 1:
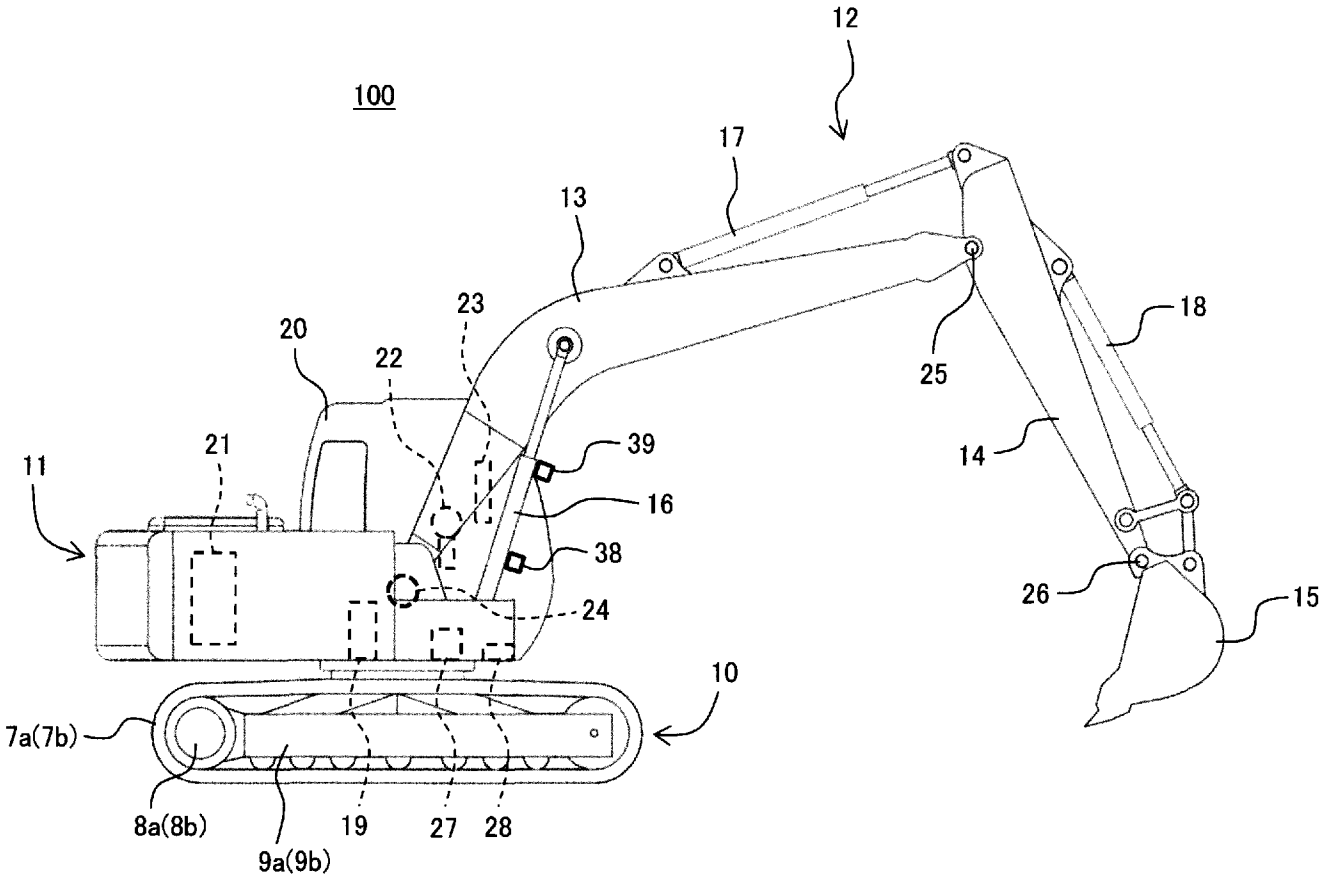
FIG. 1 is a side view schematically illustrating an external appearance of a hydraulic excavator as an example of a work machine according to Embodiment 1.

FIG. 1 is a side view schematically illustrating an external appearance of a hydraulic excavator as an example of a work machine according to the present embodiment.

In FIG. 1, a hydraulic excavator 100 includes a front work implement 12 of an articulated type (hereinafter also referred to as a work arm) constituted by a plurality of front members (a boom 13, an arm 14, and a bucket 15) each rotatable in the vertical direction and connected with each other, an upper swing structure 11 and a lower track structure 10 constituting a machine body. The upper swing structure 11 is configured to swing with respect to the lower track structure 10. A proximal end of the boom 13 of the front work implement 12 is supported on a front part of the upper swing structure 11 in such a manner as to be rotatable in the vertical direction. One end of the arm 14 is supported on the boom 13 at an end different from the proximal end in such a manner as to be rotatable in the vertical direction. The bucket 15 is supported at the other end of the arm 14 in such a manner as to be rotatable in the vertical direction.

The lower track structure 10 is constituted by a pair of crawlers 7*a* (7*b*) wound around a pair of left and right crawler frames 9*a* (9*b*), respectively, and traveling hydraulic motors 8*a* (8*b*) (each including decelerating mechanism not illustrated) for driving the crawlers 7*a* (7*b*), respectively. Concerning the respective configurations of the lower track structure 10, only one of each pair of the left and right configurations is illustrated in the figure and given a reference character, while the other configuration is given only a parenthesized reference character and not illustrated in the figure.

The boom 13, the arm 14, the bucket 15, and the lower track structure 10 are driven by a boom cylinder 16, an arm cylinder 17, a bucket cylinder 18, and the left and right traveling hydraulic motors 8*a* (8*b*), respectively, as hydraulic actuators. The upper swing structure 11 is similarly driven by a swing hydraulic motor 19 as a hydraulic actuator via a deceleration mechanism not illustrated to perform a swing operation for the lower track structure 10.

A cab 20 boarded by an operator is disposed in a front part of the upper swing structure 11. In addition, an engine as a prime mover and a hydraulic circuit system for driving the respective hydraulic actuators (both not illustrated) are mounted on the upper swing structure 11.

An operation lever device 22 operated by the operator having boarded the cab 20 to operate the hydraulic excavator 100, and an external input/output device 23 operated to display various information and input settings, for example, are disposed within the cab 20. The operation lever device 22 is a device which outputs operation signals for operating hydraulic actuators such as the boom cylinder 16, the arm cylinder 17, the bucket cylinder 18, and the swing hydraulic motor 19, and outputs operation signals corresponding to an operation direction and an operation amount of the operation lever device 22. The external input/output device 23 has a function of a display device, and a function of an operation device (e.g., an input device which includes a touch panel type display screen operated to perform selection or operation in response to a touch at the screen, and various function keys including numeric keys, and others).

A boom angle sensor 24 as a posture information sensor for detecting a relative angle of the boom 13 to the upper swing structure 11 as information associated with the posture of the boom 13 (hereinafter referred to as posture information) is disposed at a connection portion of the boom 13 connected with the upper swing structure 11 (i.e., a rotation axis corresponding to a rotation center in the vertical direction). Similarly, an arm angle sensor 25 as a posture information sensor for detecting a relative angle formed by the boom 13 and the arm 14 as posture information associated with the arm 14 is disposed at a connection portion between the boom 13 and the arm 14 (rotation axis). A bucket angle sensor 26 as a posture information sensor for detecting a relative angle of the bucket 15 to the arm 14 as posture information associated with the bucket 15 is disposed at a connection portion between the arm 14 and the bucket 15 (rotation axis). Moreover, an inclination angle sensor 28 as a posture information sensor for detecting an inclination angle of the upper swing structure 11 from a horizontal plane as posture information associated with the machine body is provided on the upper swing structure 11. Furthermore, a swing angular velocity sensor 27 for detecting a swing angular velocity of the upper swing structure 11 relative to the lower track structure 10 is disposed on the upper swing structure 11.

For example, the boom angle sensor 24, the arm angle sensor 25, and the bucket angle sensor 26 are each a variable resistor type angle sensor which converts an angle formed between targets into an electric signal such as a voltage (so-called potentiometer), and outputs electric signals obtained based on the relative angles of the respective parts as detection signals. Each of the posture information sensors disposed on the front work implement 12 is not limited to a potentiometer. For example, the posture information may be detected by using an inertial measurement unit (IMU) for measuring an angular velocity and an acceleration, or an inclination angle sensor as the posture information sensor. This point is also applicable to the inclination angle sensor 28.

The boom cylinder 16 includes a boom bottom pressure sensor 38 as a work load sensor for detecting a hydraulic pressure of a hydraulic chamber on the bottom side of the boom cylinder 16, and a boom rod pressure sensor 39 as a work load sensor for detecting a hydraulic pressure of a hydraulic chamber on the rod side of the boom cylinder 16.

The hydraulic excavator 100 includes a controller 21 which controls an overall operation of the hydraulic excavator 100, and constitutes a part of the load measuring system associated with the work machine according to the present embodiment.

Figure 2:
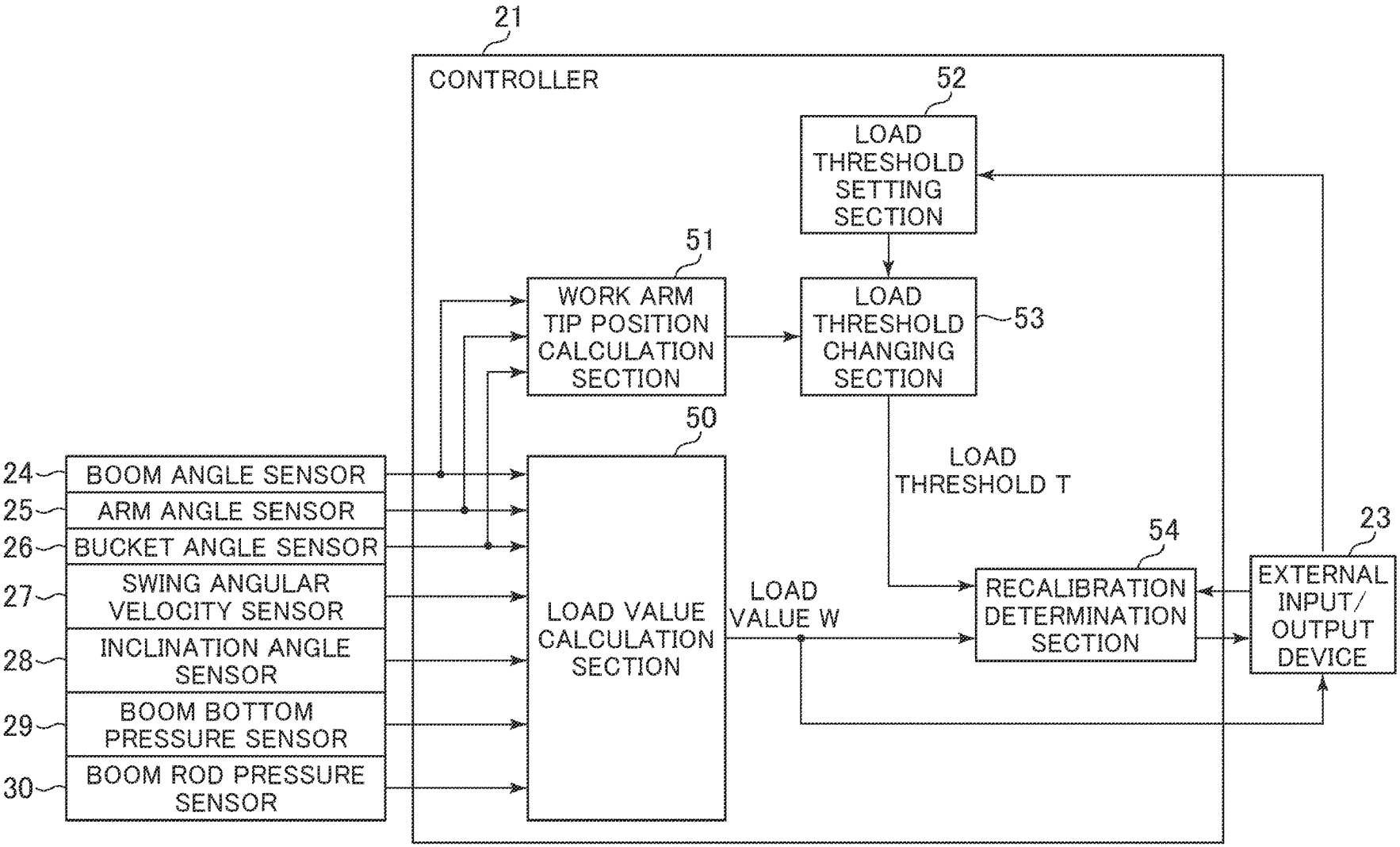
FIG. 2 is a functional block diagram schematically illustrating a configuration associated with a load measuring system including a controller.

FIG. 2 is a functional block diagram schematically illustrating a configuration associated with a load measuring system including a controller.

In FIG. 2, the controller 21 includes: a load value calculation section 50 which calculates a load value as a weight of a transportation target (e.g., excavated object such as soil) carried by the bucket 15 of the front work implement 12 based on detection results of the work load sensors (the boom bottom pressure sensor 38 and the boom rod pressure sensor 39) and detection results of the posture information sensors (the boom angle sensor 24, the arm angle sensor 25, the bucket angle sensor 26, the swing angular velocity sensor 27, and the inclination angle sensor 28); a work arm tip position calculation section 51 which calculates a tip position of the front work implement 12 (i.e., tip position of the bucket 15, hereinafter referred to as a work arm tip position) as a posture index value which is an index concerning a posture of the front work implement 12 based on detection results of the posture information sensors (the boom angle sensor 24, the arm angle sensor 25, and the bucket angle sensor 26); a load threshold setting section 52 which sets a load threshold table determining beforehand a relation between the posture index value and a plurality of candidate values of a load threshold used for determining whether to recalibrate the load measuring system based on settings input by the operator through the external input/output device 23; a load threshold changing section 53 which changes the load threshold in accordance with the load threshold table set by the load threshold setting section 52 and a calculation result (posture index value) obtained by the work arm tip position calculation section 51; and a recalibration determination section 54 which determines whether to recalibrate the load measuring system based on the load threshold received from the load threshold changing section 53 and a calculation result obtained by the load value calculation section 50 in an unladen state where no transportation target is present on the bucket 15 when an instruction of a start of a recalibration determination process is issued from the operator via the external input/output device 23, and notifies the operator of a determination result by displaying the determination result on a function section of the external input/output device 23 as a display device. The respective processes are performed by the controller 21 in accordance with a sampling time set beforehand.

Figure 3:
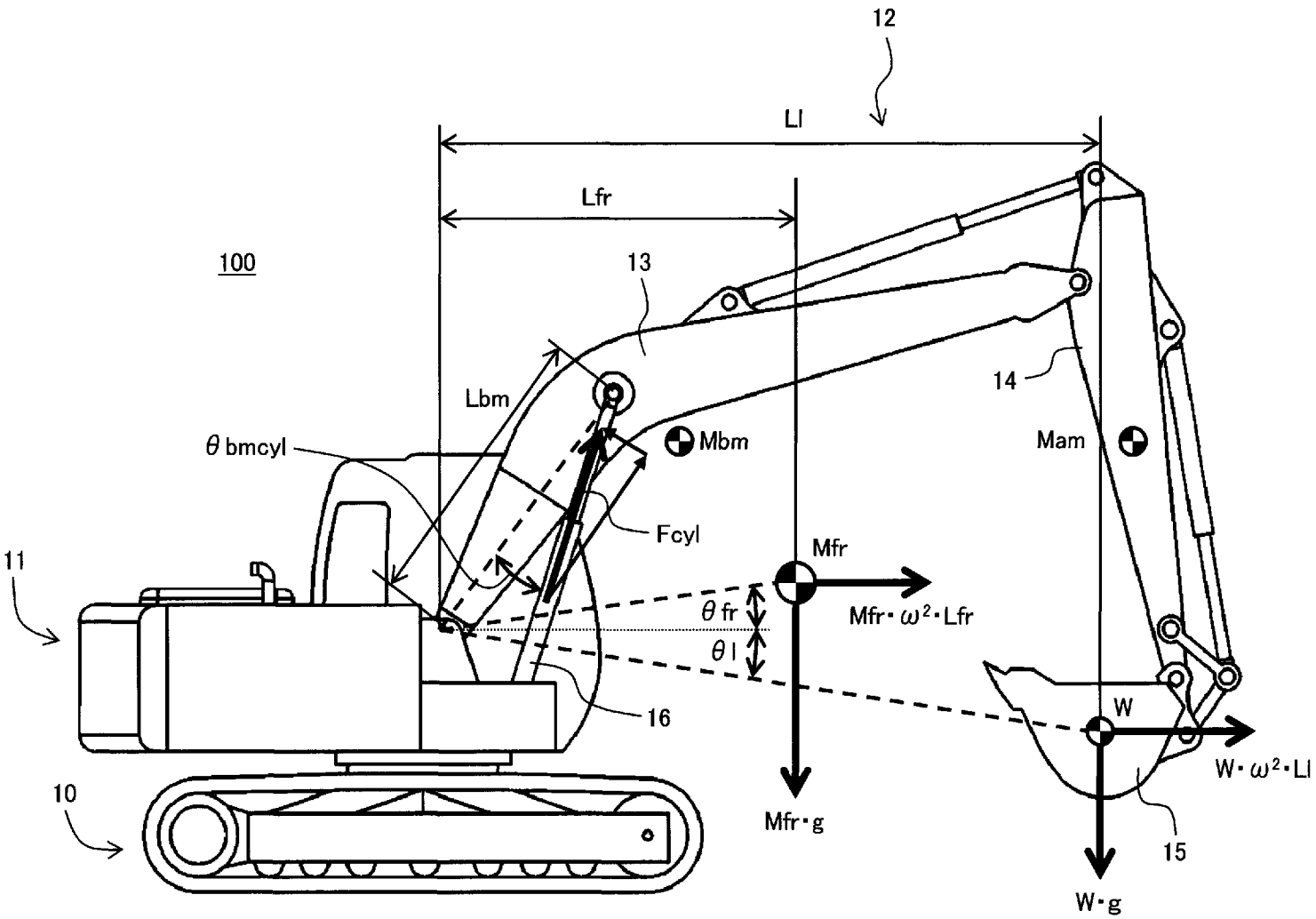
FIG. 3 is a view explaining a principle of a load value calculation process performed by a load value calculation section.

FIG. 3 is a view explaining a principle of a load value calculation process performed by the load value calculation section.

As illustrated in FIG. 3, the load value calculation section 50 calculates a load value based on a balance between three torques in the front work implement 12, i.e., a torque generated around the rotation axis of the boom 13 relative to the upper swing structure 11 by an action of a thrust of the boom cylinder 16, a torque generated around the rotation axis of the boom 13 relative to the upper swing structure 11 by the gravity and a swing centrifugal force acting on the front work implement 12, and a torque generated around the rotation axis of the boom 13 relative to the upper swing structure 11 by the gravity and a swing centrifugal force acting on the transportation target carried by the bucket 15. According to the present embodiment, it is assumed that the proximal end of the boom 13 is located above the swing center of the upper swing structure 11 relative to the lower track structure 10 for easy understanding of the description. However, a deviation amount of the relative positions of the swing center of the upper swing structure 11 and the proximal end of the boom 13, both positions of which are known based on design information or the like, may be reflected in following calculations and the like to obtain more accurate values.

A thrust Fcyl of the boom cylinder 16 is computed by multiplying each of a detection result of the boom bottom pressure sensor 38 and a detection result of the boom rod pressure sensor 39 by a pressure receiving area of the bottom side or the rod side of the boom cylinder 16, and then calculating a difference between the multiplied results. Moreover, assuming that a length of a line segment connecting the rotation axis of the boom 13 relative to the upper swing structure 11 and the action point of the thrust of the boom cylinder 16 (i.e., a connection portion between the rod of the boom cylinder 16 and the boom 13) is Lbm, and that an angle formed by the thrust Fcyl of the boom cylinder 16 and the line segment Lbm is θbmcyl, a torque Tbm generated around the rotation axis of the boom 13 relative to the upper swing structure 11 by an action of the thrust Fcyl of the boom cylinder 16 is computed by following (Equation 1).

$$Tbm=Fcyl\cdot Lbm\cdot\sin(\theta bmcyl) \quad \text{(Equation 1)}$$

Assuming that the weight of the center of gravity and a gravity acceleration of the front work implement 12 are Mfr and g, respectively, and that a length between the rotation axis of the boom 13 relative to the upper swing structure 11 and the position of the center of gravity of the front work implement 12 in the front-rear direction is Lfr, a torque Tgfr generated around the rotation axis of the boom 13 relative to the upper swing structure 11 by the gravity acting on the front work implement 12 is computed by following (Equation 2).

$$Tgfr=Mfr\cdot g\cdot Lfr \quad \text{(Equation 2)}$$

Assuming that a swing angular velocity detected by the swing angular velocity sensor 27 is ω, and that an angle formed by the horizontal plane and a line segment connecting the rotation axis of the boom 13 relative to the upper swing structure 11 and the position of the center of gravity of the front work implement 12 is θfr, a torque Tcfr generated around the rotation axis of the boom 13 relative to the upper swing structure 11 by a swing centrifugal force acting on the front work implement 12 is computed by following (Equation 3).

$$Tcfr=Mfr\cdot Lfr\cdot\omega^2\cdot\sin(\theta fr) \quad \text{(Equation 3)}$$

The center of gravity Mfr, the length Lfr, and the angle θfr are computed based on the position of the center of gravity and the weight of each of the boom 13, the arm 14, and the bucket 15 set beforehand, and the detection results obtained by the boom angle sensor 24, the arm angle sensor 25, the bucket angle sensor 26, and the inclination angle sensor 28.

Assuming that a load value of the transportation target is W, and that a length between the rotation axis of the boom 13 relative to the upper swing structure 11 and the position of the center of gravity of the bucket 15 in the front-rear direction is Ll, a torque Tgl generated around the rotation axis of the boom 13 relative to the upper swing structure 11 by the gravity acting on the transportation target carried by the bucket 15 is computed by following (Equation 4).

$$Tgl=W\cdot g\cdot Ll \quad \text{(Equation 4)}$$

Assuming that an angle formed by the horizontal plane and a line segment connecting the rotation axis of the boom 13 relative to the upper swing structure 11 and the position of the center of gravity of the transportation target is θl, a torque Tcl generated around the rotation axis of the boom 13 relative to the upper swing structure 11 by the gravity acting on the transportation target carried by the bucket 15 is computed by following (Equation 5).

$$Tcl=W\cdot Ll\cdot\omega^2\cdot\sin(\theta l) \quad \text{(Equation 5)}$$

Following (Equation 6) holds considering a balance of the torques computed by (Equation 1) to (Equation 5) described above. Accordingly, (Equation 6) is developed concerning the load value W of the transportation target, and the load value W of the transportation target is computed by following (Equation 7).

$$Tbm=Tgfr+Tcfr+Tgl+Tcl \quad \text{(Equation 6)}$$

$$W=(Tbm-Tgfr-Tcfr)/(Ll\cdot(g+\omega^2\cdot\sin(\theta l))) \quad \text{(Equation 7)}$$

Figure 4:
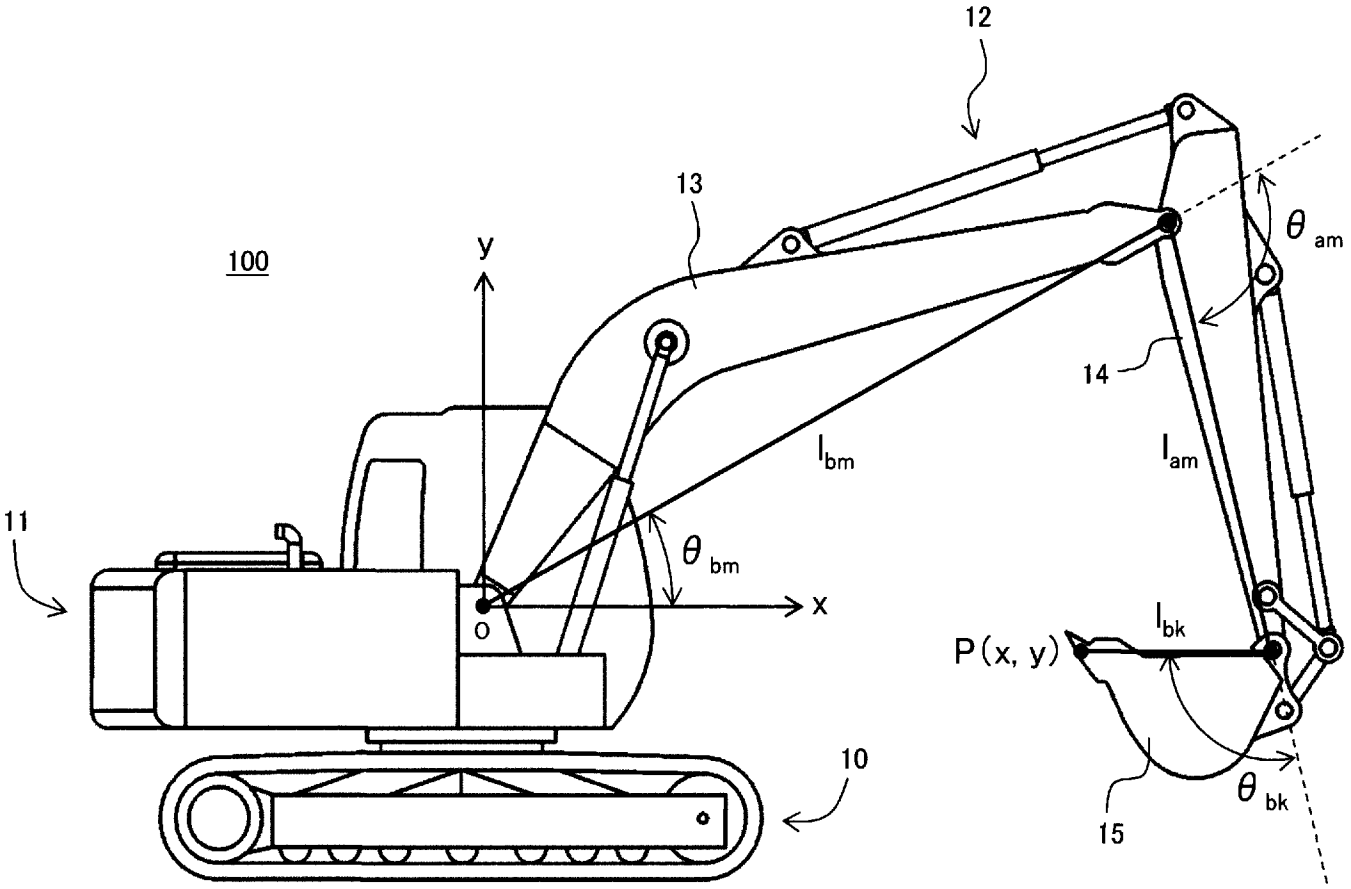
FIG. 4 is a view explaining a principle of a process performed by a work arm tip position calculation section for calculating a tip position of a front work implement.

FIG. 4 is a view explaining a principle of a process performed by the work arm tip position calculation section for calculating the tip position of the front work implement.

As illustrated in FIG. 4, the work arm tip position calculation section 51 sets a tip P for the bucket 15 as a tip position of the front work implement 12 (work arm tip position), and calculates the position of the tip P as a coordinate value P (x, y) of an x-y coordinate system whose origin is located on the rotation axis of the boom 13 relative to the upper swing structure 11. The x-y coordinate system is a rectangular coordinate system fixed to the upper swing structure 11, and set on an operation plane of the front work implement 12.

In the x-y coordinate system set in this manner, assuming that a link length of the boom 13 (the distance between the rotation axis of the boom 13 relative to the upper swing structure 11 and the rotation axis of the arm 14 relative to the boom 13), a link length of the arm 14 (the distance between the rotation axis of the arm 14 relative to the boom 13 and the rotation axis of the bucket 15 relative to the arm 14), and a link length of the bucket 15 (the distance between the rotation axis of the bucket 15 relative to the arm 14 and the tip P of the bucket 15) are lbm, lam, and lbk, respectively, and that an angle formed by a link length direction of the boom 13 and the horizontal plane, a relative angle formed by a link length direction of the arm 14 and the link length direction of the boom 13, and a relative angle formed by a link length direction of the bucket 15 and the link length direction of the arm 14 are a boom angle θbm, an arm angle θam, and a bucket angle θbk, respectively, a position x and a position y of the tip P of the bucket 15 in the horizontal direction and in the vertical direction, respectively, are computed by following (Equation 8) and (Equation 9).

$$x=lbm\cdot\cos(\theta bm)+lam\cdot\cos(\theta bm+\theta am)+lbk\cdot\cos(\theta bm+\theta am+\theta bk) \quad \text{(Equation 8)}$$

$$y=lbm\cdot\sin(\theta bm)+lam\cdot\sin(\theta bm+\theta am)+lbk\cdot\sin(\theta bm+\theta am+\theta bk) \quad \text{(Equation 9)}$$

The load threshold setting section 52 sets a load threshold table which determines beforehand a relation between a posture index value (work arm tip position) and a plurality of candidate values of a load threshold T used by the recalibration determination section 54 based on settings input by the operator through the external input/output device 23. There are various methods adoptable for setting the load threshold table. For example, adoptable is a method of selecting a load threshold table from a plurality of load threshold tables and setting the selected table, or a method of setting respective setting values of a selected load threshold table in accordance with any input from the operator.

Figure 5:
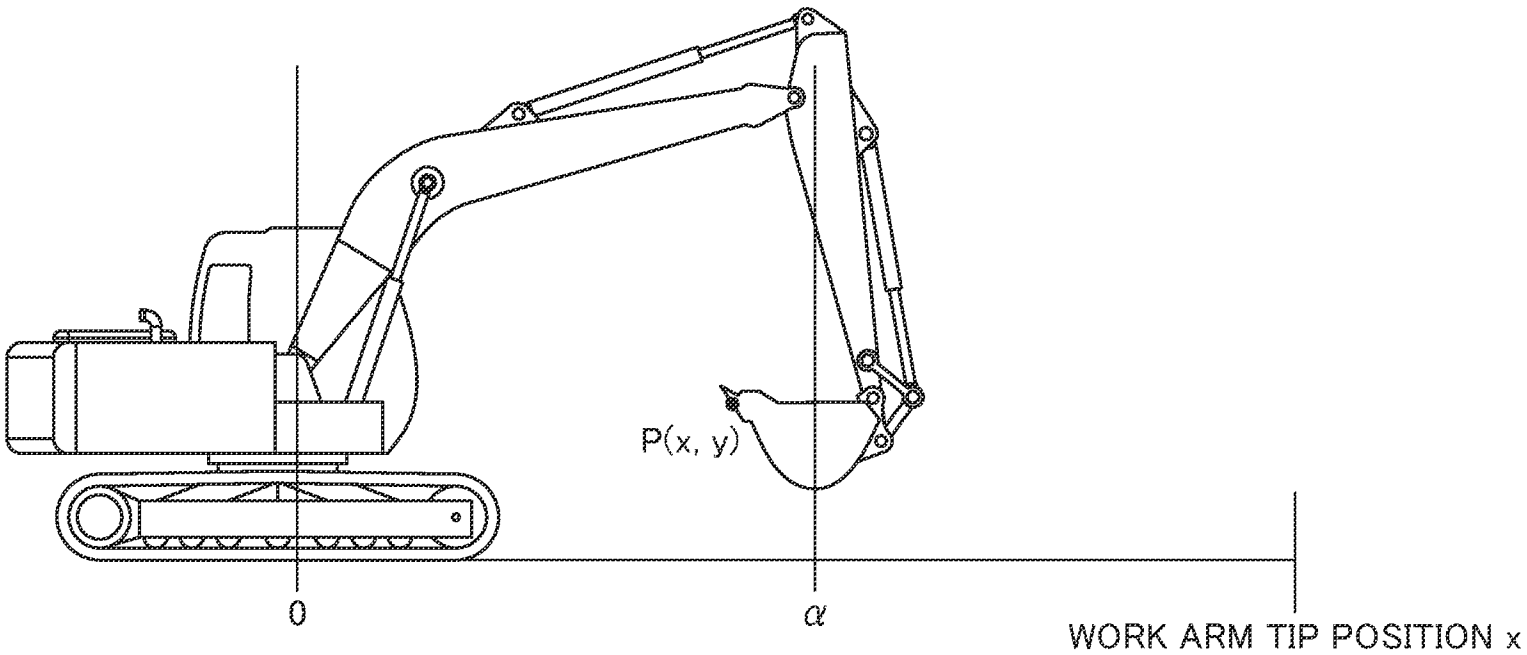
FIG. 5 is a diagram illustrating an example of a load threshold table set by a load threshold setting section, and used for a load threshold changing process performed by a load threshold changing section, and a side view illustrating a relation between a hydraulic excavator and a work arm tip position.

FIG. 5 is a diagram illustrating an example of the load threshold table set by the load threshold setting section, and used for a load threshold changing process performed by the load threshold changing section, and a side view illustrating a relation between the hydraulic excavator and the work arm tip position.

As illustrated in FIG. 5, the load threshold table presented by way of example specifies a relation between a plurality of (two in this example) candidate values (T1, T2) of the load threshold T, and the x coordinate of the work arm tip position as the posture index value. The load threshold changing section 53 sets the load threshold T to T1 when the x coordinate of the work arm tip position is smaller than a boundary value α determined beforehand. The load threshold changing section 53 sets the load threshold T to T2 when the x coordinate of the work arm tip position is equal to or larger than the boundary value α. For example, values such as the boundary value α and the candidate values (T1, T2) of the load threshold T specified in the load threshold table are determined based on an experiment result, a simulation result or the like.

Figure 6:
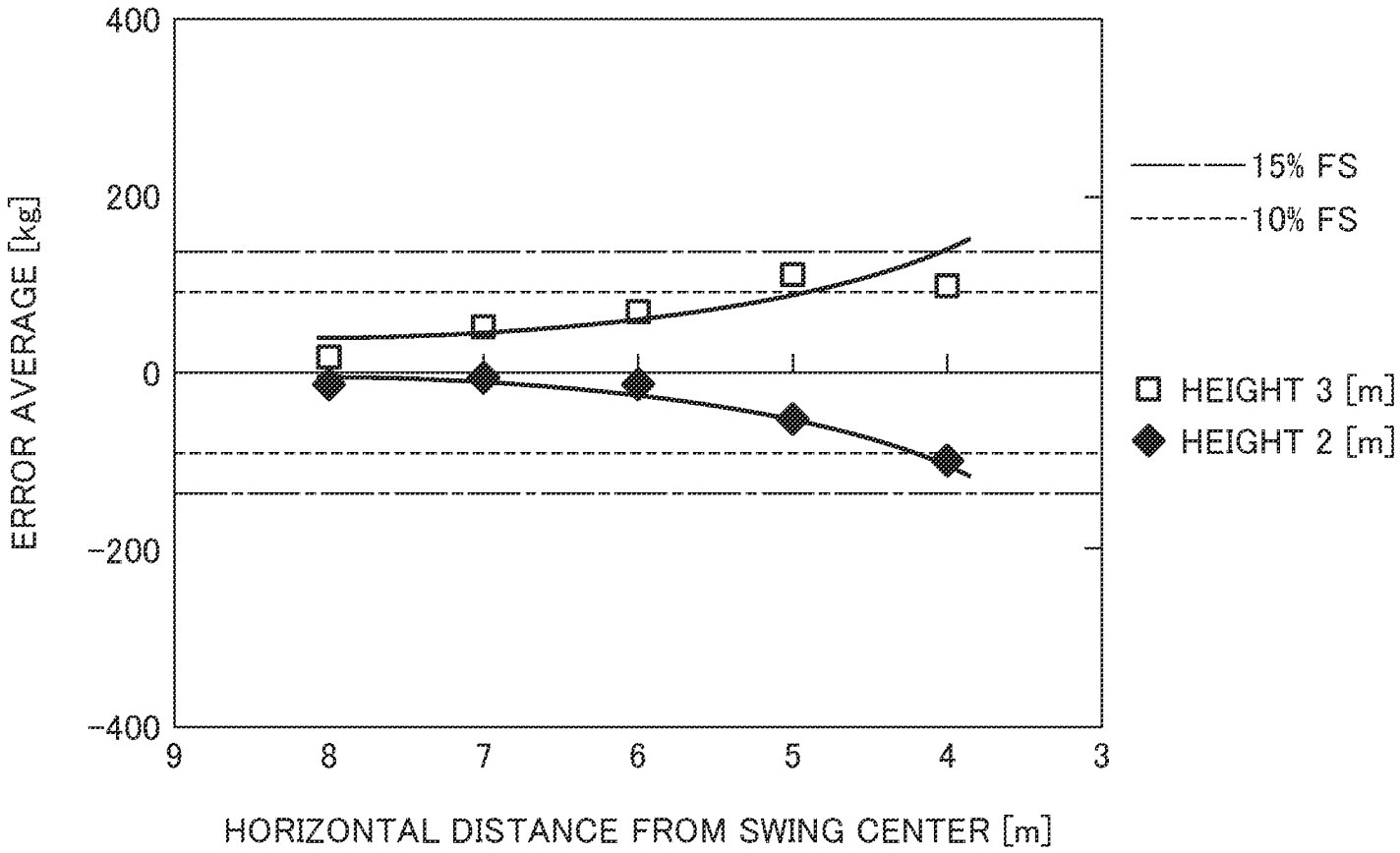
FIG. 6 is a diagram explaining an example of a method for specifying respective values in the load threshold table.

FIG. 6 is a diagram explaining an example of a method for specifying respective values in the load threshold table, illustrating a graph of a relation between a horizontal distance from a swing center in an unladen state, and load errors (differences between load values computed from detection values of the respective sensors 24 to 28, 38, and 39 and actual load values) in the case of an example of a hydraulic excavator having a bucket capacity of 0.8 $m^3$ and a maximum value of approximately 9 m for the x coordinate of the work arm tip position, when the relation is measured in the case of the bucket 15 located at a height of 2 [m] or 3 [m] from the ground surface. As can be seen from FIG. 6, a deviation of the load becomes ±10% full-scale (hereinafter referred to as F. S.) when the x coordinate of the work arm tip position is equal to or larger than approximately ½ of the maximum value. The deviation of the load lies approximately in a range from ±10% F. S. to ±15% F. S. as a result of accuracy deterioration when the x coordinate of the work arm tip position is equal to or smaller than approximately ½ of the maximum value. Accordingly, in the case of a hydraulic excavator having the maximum value 10 m for the x coordinate of the work arm tip position and F. S. of 1.0 ton for simplifying numerals, 5 m is input beforehand to the boundary value α, and 0.15 ton and 0.1 ton are input beforehand to the load threshold (candidate value) T1 and the load threshold (candidate value) T2, respectively. These values can be changed in accordance with purposes by inputting respective values of the load threshold table from the operator through the external input/output device 23.

Figure 7:
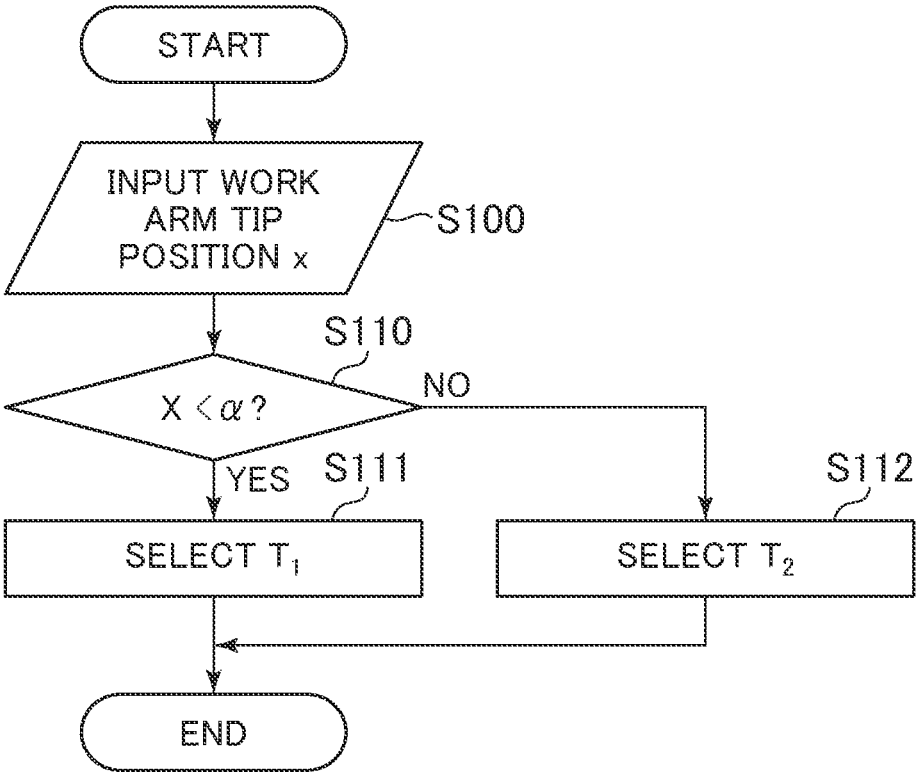
FIG. 7 is a flowchart representing the load threshold changing process performed by the load threshold changing section.

FIG. 7 is a flowchart representing the load threshold changing process performed by the load threshold changing section.

In a state that the x coordinate of the work arm tip position has been input as a calculation result of the work arm tip position calculation section 51 (step S100) in FIG. 7, the load threshold changing section 53 determines whether or not the coordinate value x is smaller than the boundary value α specified in the load threshold table (step S110). When the determination result is YES, i.e., when the work arm tip position is located in a region at a distance shorter than a distance α from the origin O in the x axis direction in the x-y coordinate system, the load threshold T is set to T1 (step S111). Thereafter, the process ends. When the determination result is NO in step S110, i.e., when the work arm tip position is located in a region at a distance equal to or longer than the distance α from the origin O in the x axis direction in the x-y coordinate system, the load threshold T is set to T2 (step S112). Thereafter, the process ends.

Figure 8:
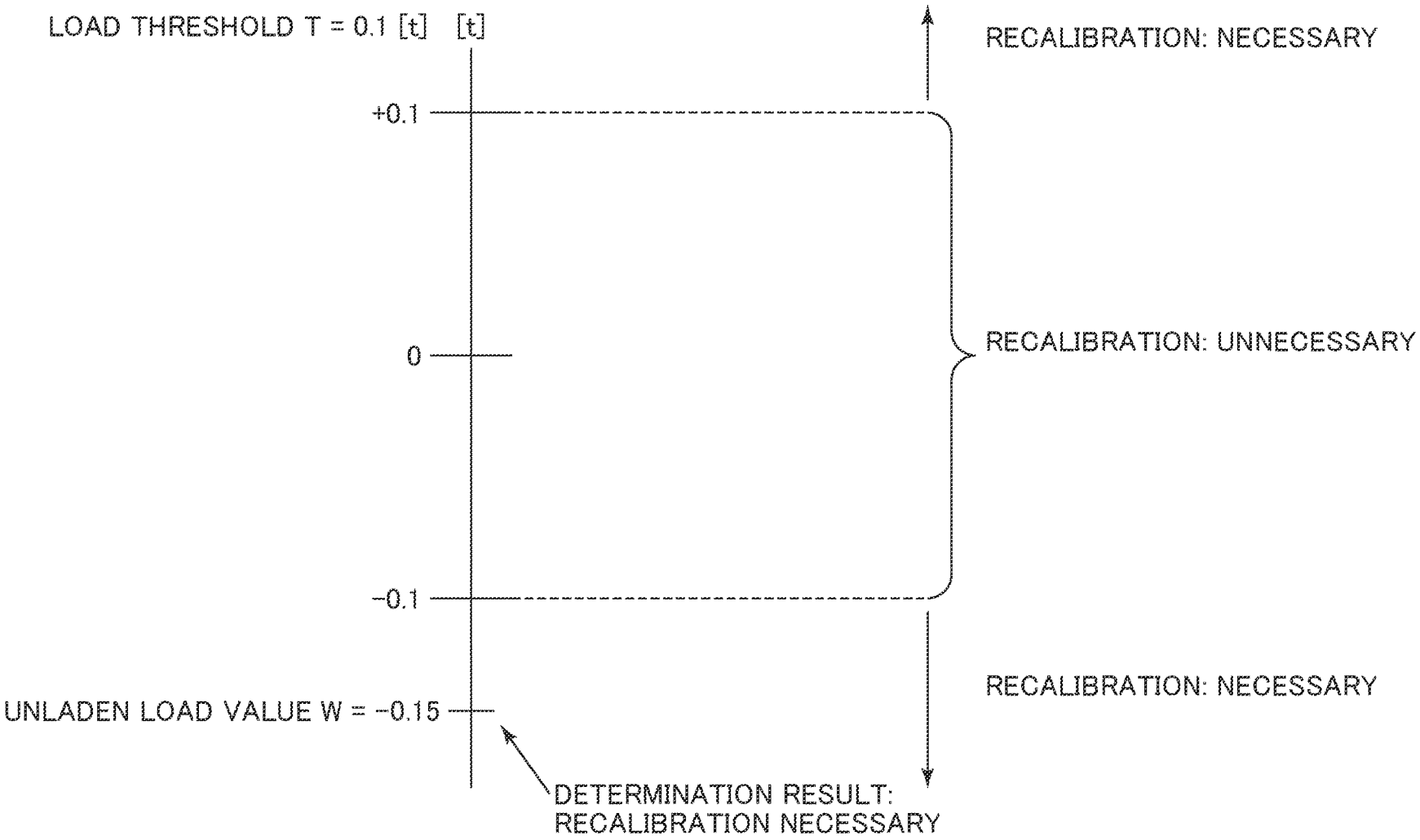
FIG. 8 is a diagram illustrating a concept of a recalibration determination process performed by a recalibration determination section.

FIG. 8 is a diagram illustrating a concept of a recalibration determination process performed by the recalibration determination section.

FIG. 8 illustrates a case that −0.15 [t] has been input from the load value calculation section 50 to the recalibration determination section 54 as the load value W in the unladen state, and that 0.1 [t] has been input from the load threshold changing section 53 to the recalibration determination section 54 as the load threshold T. The load threshold T in the recalibration determination section 54 specifies a width of a region around 0 [t], which is a true value of the load value in the unladen state, in a positive-negative direction. When the load value W in the unladen state is present inside (not including the boundary) a region specified by the load threshold T, the recalibration determination section 54 determines that recalibration of the load measuring system is unnecessary. When the load value W in the unladen state is present outside (including the boundary) the region specified by the load threshold T, the recalibration determination section 54 determines that recalibration of the load measuring system is necessary.

For example, when the load threshold T is 0.1 [t] as illustrated in FIG. 8, the load threshold T specifies a range of 0.1 [t] both in the positive direction and in the negative direction from 0 [t]. When the load value W is −0.15 [t] in the unladen state in this condition, the recalibration determination section 54 determines that recalibration is necessary.

Figure 9:
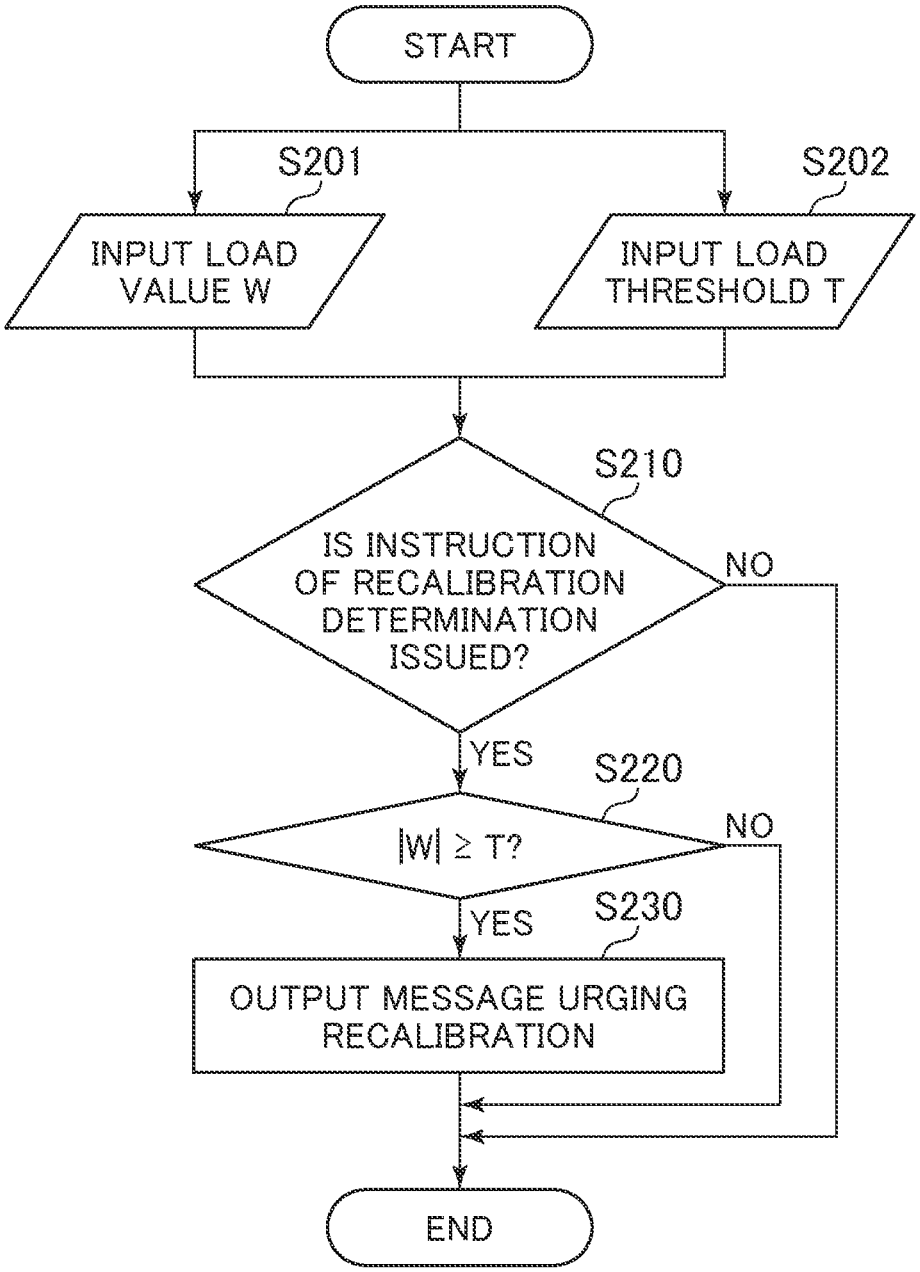
FIG. 9 is a flowchart representing the recalibration determination process performed by the recalibration determination section.

FIG. 9 is a flowchart representing a recalibration determination process performed by the recalibration determination section.

In FIG. 9, the recalibration determination section 54 determines whether or not an instruction of a start of the recalibration determination process has been issued (step S210) in a state that the load value W has been input as a calculation result of the load value calculation section 50 (step S201) and that the load threshold T has been input from the load threshold changing section 53 (step S202). When the determination is YES, it is determined whether or not an absolute value of the load value W (|W|) is the load threshold T or larger (step S220). When the determination result is YES in step S220, a message urging recalibration is displayed as the determination result on a display screen 30 of the external input/output device 23 (see FIG. 11 and other figures referred to below) to notify the operator of the determination result (step S130). Thereafter, the process ends. When at least either one of the determination results in steps S210 and S220 is NO, the process ends.

Figure 10:
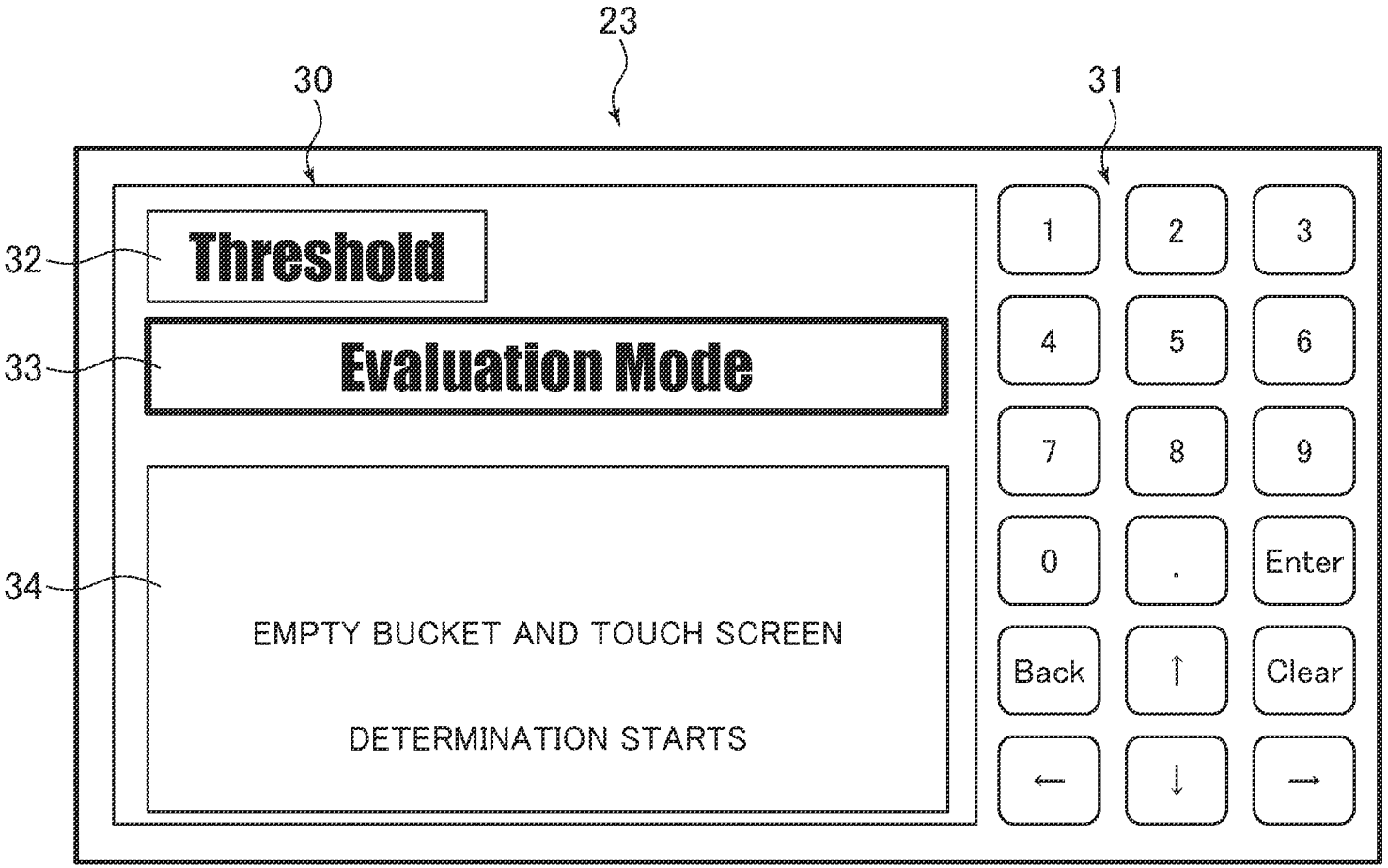
FIG. 10 is a view schematically illustrating an external input/output device and a display example of the external input/output device, as a view illustrating a display example when a mode for performing the recalibration determination process is selected.
Figure 11:
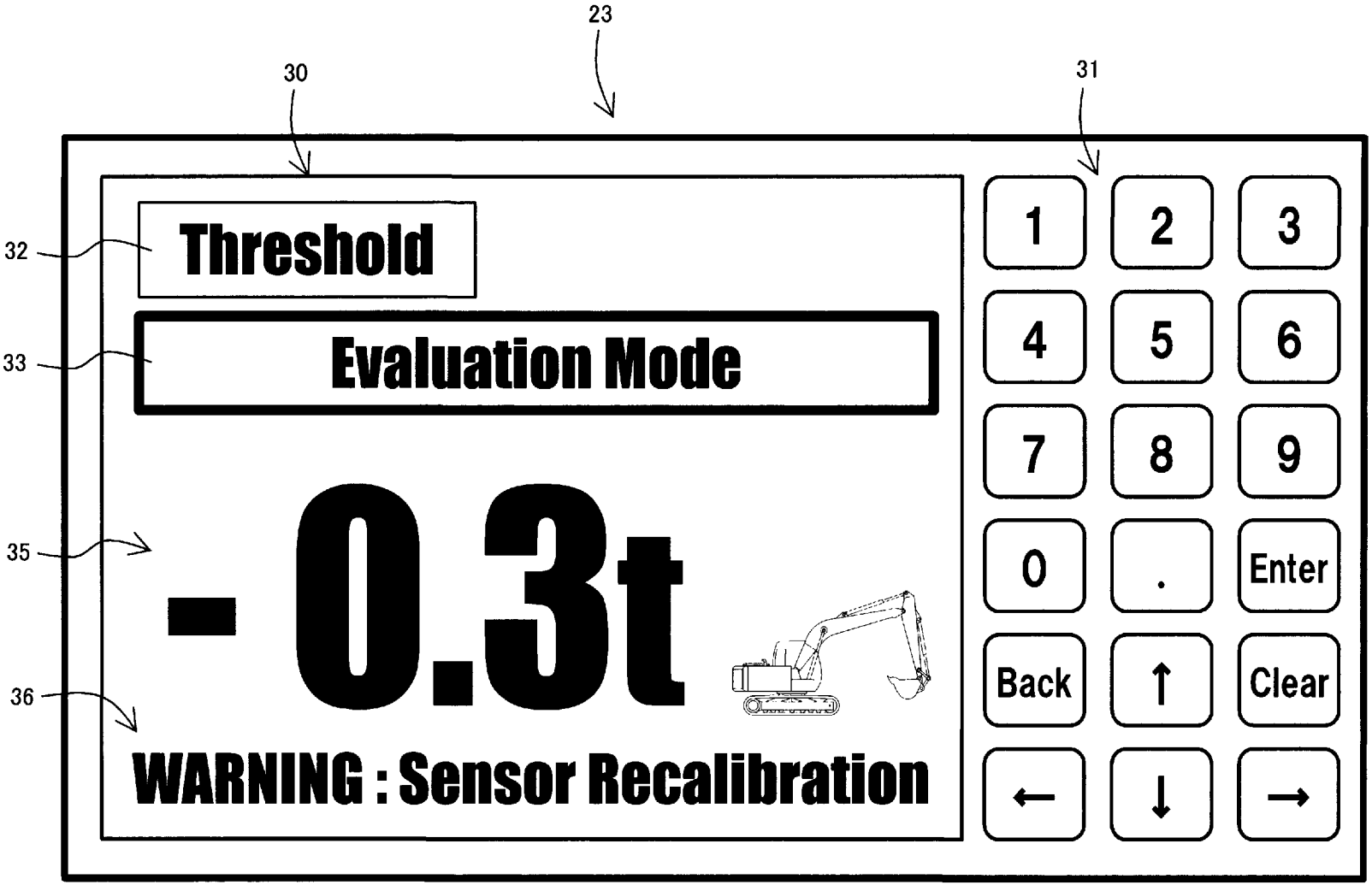
FIG. 11 is a view schematically illustrating the external input/output device and a display example of the external input/output device, as a view illustrating a display example of a determination result of the recalibration determination process.

Each of FIGS. 10 and 11 is a view schematically illustrating the external input/output device and a display example of the external input/output device. FIG. 10 illustrates a display example when a mode for performing the recalibration determination process is selected, while FIG. 11 illustrates a display example of the determination result of the recalibration determination process.

As illustrated in FIGS. 10 and 11, the external input/output device 23 includes the display screen 30 of a touch panel type having a function as a display device and a function as an operation device, and numeric keys 31 (including various function keys such as a direction key, a decision key, a cancel key, and a back key, hereinafter collectively and simply referred to as numeric keys) having a function as an operation device/input device, and others.

FIG. 10 illustrates a case where an "Evaluation mode" button (determination mode button) 33 for selecting a mode performing the recalibration determination process (recalibration determination mode) has been selected by operating a menu display not illustrated or the like of the display screen 30. For example, FIG. 10 illustrates a "Threshold" button (threshold button) 32 for calling a threshold setting screen for changing settings of the load threshold table or respective values of the load threshold table, a determination process start button 34 for instructing a start of the recalibration determination process with display of a message which urges a change of the state of the hydraulic excavator 100 into a state matching a condition for performing the recalibration determination process.

In FIG. 10, information in the form illustrated in FIG. 5 is displayed in the display screen 30, for example, in response to a touch at the threshold button 32. In this case, a numeric value input state is produced by touching a portion where the boundary value $\alpha$ is displayed in the table in the lower part. The value of the boundary value $\alpha$ dividing the region of the work arm tip position in the x axis direction is changed using the numeric keys 31. The boundary value $\alpha$ is changed by a press of an "Enter" key of the numeric keys 31. The origin of the coordinate at this time corresponds to the rotation axis of the boom 13. Similarly, a numeric value input state is produced by touching respective portions displayed in the display screen 30, where the candidate values T1 and T2 of the load threshold in the table in the lower part of the information in FIG. 5 are displayed. The candidate values T1 and T2 of the load threshold are input using the numeric keys 31. The candidate values T1 and T2 of the load threshold are changed by a press of the "Enter" key of the numeric keys 31. After completion of all inputs, a "Back" key of the numeric keys 31 is pressed to return to the screen in FIG. 11.

In FIG. 10, an outer periphery of the determination mode button 33 is displayed with highlight to indicate a switchover to the mode performing the recalibration determination process in response to a touch by the operator at the determination mode button 33. When the determination mode button 33 is selected in this manner, the determination process start button 34 is displayed with a display of a message which urges a change of the state of the hydraulic excavator 100 into the state matching with the condition for performing the recalibration determination process (i.e., urges the bucket 15 to become empty). As a result, a standby state before a start of the recalibration determination process is produced. When the operator touches the determination process start button 34 in this state, the display of the determination process start button 34 disappears. Thereafter, the recalibration determination process starts.

FIG. 11 depicts a state where a determination result of the recalibration determination process is displayed in the display screen 30, illustrating the determination mode button 33, the threshold button 32, and also a load value display portion 35 for displaying a measurement result of the load value W, and a message display portion 36 for displaying a message corresponding to the determination result, in place of the determination process start button 34 in FIG. 10. The example in FIG. 11 illustrates a case where −0.3 [t] is displayed in the load value display portion 35 as the measurement result of the load value W, with a display of a message urging recalibration of the load measuring system in the message display portion 36 in correspondence with the determination that recalibration is necessary as a result of the recalibration determination process.

Advantageous effects of the present embodiment configured as above will be described.

Measuring accuracy of a load measuring device may lower by deterioration of a sensor or a measuring mechanism. Accordingly, use of a device for correcting deviation such that a load in an unladen state becomes zero, or recalibration of a sensor used for load measurement is required, for example. However, when a load measuring device of a work machine equipped with a front work implement measures a load based on a torque balance between a torque generated by the front work implement carrying soil itself at a proximal rotation unit of the front work implement and a torque generated by a hydraulic cylinder which drives the proximal rotation unit of the front work implement, for example, an effect of an error relatively increases and deteriorates measuring accuracy in such a posture that a distance between the proximal rotation unit of the front work implement and the center of gravity of the soil carried by the front work implement becomes short. Moreover, frictional resistance within the hydraulic cylinder varies in accordance with an operation velocity of the front work implement. In this case, an error of a measurement value may be produced. More specifically, in principle, the load measuring device of the work machine equipped with the front work implement has such a characteristic that measuring accuracy varies in accordance with the posture or the operation of the front work implement. Accordingly, deterioration of measuring accuracy is difficult to appropriately detect.

According to the present embodiment, a work machine (e.g., the hydraulic excavator 100) includes: a machine body (e.g., the upper swing structure 11); a front work implement 12 that is an articulated type, is attached to the machine body, and includes a plurality of front members (e.g., the boom 13, the arm 14, and the bucket 15) rotatably connected to each other; a plurality of hydraulic actuators (e.g., the boom cylinder 16) that respectively drive the plurality of front members of the front work implement in accordance with operation signals; a load measuring system that includes a work load sensor (e.g., the boom bottom pressure sensor 38 and the boom rod pressure sensor 39) detecting work loads of the hydraulic actuators, a plurality of posture information sensors (e.g., the boom angle sensor 24, the arm angle sensor 25, the bucket angle sensor 26, the swing angular velocity sensor 27, and the inclination angle sensor 28) detecting posture information that is information associated with respective postures of the plurality of front members and the machine body, and a controller (e.g., the controller 21) calculating a load value as a weight of a transportation target carried by the front work implement based on detection results obtained by the work load sensor and the posture information sensors; and a display device (e.g., the display screen 30) disposed inside the cab 20 boarded by the operator. The controller is capable of changing a load threshold used for determining whether to recalibrate the load measuring system in accordance with a posture index value that is an index concerning a posture of the front work implement and obtained based on the detection results of the posture information sensors. The controller determines whether to recalibrate the load measuring system based on a calculation result of the load value and the changed load threshold, and displays a determination result on the display device. Accordingly, deterioration of measuring accuracy is more appropriately detectable regardless of variations of the posture of the front work implement of the work machine.

Moreover, a manger or an operator may take measures for calibration with reference to the result of the recalibration determination process. For example, zero point correction for reducing an offset of the unladen weight to zero when a similar deviation is produced in both of the cases of the load thresholds of the T1 and T2. Calibration of the posture sensor is performed when a large difference is produced between errors in the cases of the load thresholds of T1 and T2.

Furthermore, a change of the load threshold T set beforehand for each of the plurality of divided regions of the tip position is only required at the time of use. Accordingly, initial settings and a change of settings are extremely easy.

According to the present embodiment described by way of example, two regions are set in the x coordinate using the boundary value α. However, the number of the set regions is not limited to this number, but may be three or more to set necessary regions. However, it is preferable that the three or more regions are set with reference to an experiment result obtained by measuring the relation between the actual load error and the posture. While the example which sets regions in the x coordinate has been described, a configuration which sets a plurality of regions in the vertical direction (y coordinate) may be adopted.

According to the present embodiment presented by way of example, the recalibration determination process is started when the operator turns on the recalibration determination button in the unladen state. However, the starting trigger of the recalibration determination process is not limited to this example. For example, adoptable is such a configuration which determines a swing return operation after loading based on detection values obtained by the swing angular velocity sensor and a boom lowering pilot pressure sensor not illustrated, and automatically performs the recalibration determination process at the time of the swing return operation.

According to the present embodiment presented by way of example, the operator is notified of the message urging recalibration by the screen display. However, any other configurations of display modes and display contents may be adopted. For example, an audio device such as a speaker may be provided inside the cab to notify the operator of a message urging recalibration by voices.

Embodiment 2

Embodiment 2 of the present invention will be described with reference to FIGS. 12 to 15. Only differences between the present embodiment and Embodiment 1 will be described. Components similar to the corresponding components of Embodiment 1 in the figures referred to in the present embodiment are given similar reference characters, and the same explanation is not repeated.

According to the present embodiment, the load threshold changing section 53 uses not only the work arm tip position as the posture index value as in Embodiment 1, but also a work arm operation velocity as the posture index value to change the load threshold in accordance with the work arm tip position and the work arm operation velocity.

Figure 12:
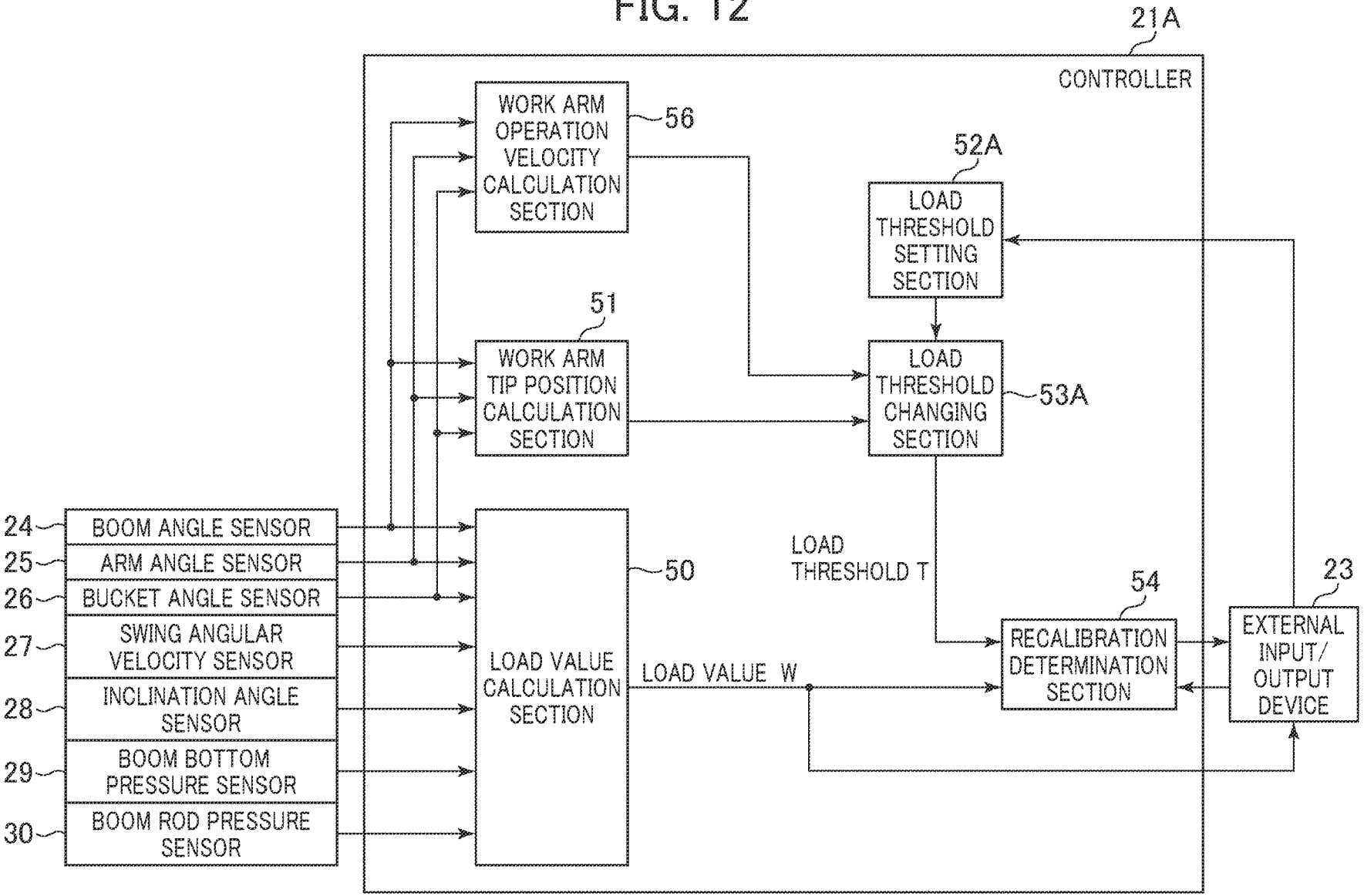
FIG. 12 is a functional block diagram schematically illustrating a configuration associated with a load measuring system including a controller according to Embodiment 2.

FIG. 12 is a functional block diagram schematically illustrating a configuration associated with a load measuring system including a controller.

In FIG. 12, a controller 21A includes: the load value calculation section 50 which calculates a load value as a weight of a transportation target (e.g., excavated object such as soil) carried by the bucket 15 of the front work implement 12 based on detection results of the work load sensors (the boom bottom pressure sensor 38 and the boom rod pressure sensor 39) and detection results of the posture information sensors (the boom angle sensor 24, the arm angle sensor 25, the bucket angle sensor 26, the swing angular velocity sensor 27, and the inclination angle sensor 28); the work arm tip position calculation section 51 which calculates a tip position of the front work implement 12 (i.e., tip position of the bucket 15, hereinafter referred to as a work arm tip position) as a posture index value which is an index concerning a posture of the front work implement 12 based on detection results of the posture information sensors (the boom angle sensor 24, the arm angle sensor 25, and the bucket angle sensor 26); a work arm operation velocity calculation section 56 which calculates an extension velocity of the boom cylinder 16 (hereinafter referred to as a work arm operation velocity) as a posture index value corresponding to an index concerning the posture of the front work implement 12 based on the detection result of the posture information sensor (the boom angle sensor 24); the load threshold setting section 52 which sets a load threshold table determining beforehand a relation between posture index values and a plurality of candidate values of a load threshold used for determining whether to recalibrate the load measuring system based on settings input by the operator through the external input/output device 23; a load threshold changing section 53A which changes the load threshold in accordance with the load threshold table set by the load threshold setting section 52 and calculation results of the work arm tip position calculation section 51 and the work arm operation velocity calculation section 56; and the recalibration determination section 54 which determines whether to recalibrate the load measuring system based on the load threshold received from the load threshold changing section 53 and a calculation result obtained by the load value calculation section 50 in an unladen state where no transportation target is present on the bucket 15 when an instruction of a start of a recalibration determination process is issued from the operator via the external input/output device 23, and notifies the operator of a determination result by displaying the determination result on a function section of the external input/output device 23 as a display device.

The work arm operation velocity calculation section 56 converts a boom angle (a detection result obtained by the boom angle sensor 24) continuously sampled into a cylinder length, and divides a change amount of the cylinder length by a sampling time to calculate the work arm operation velocity (an extension velocity v of the boom cylinder 16).

FIG. 13 is a diagram illustrating an example of the load threshold table set by the load threshold setting section, and used for a load threshold changing process performed by the load threshold changing section.

As illustrated in FIG. 13, the load threshold table according to the present embodiment specifies a relation between a plurality of (four in this example) candidate values (T11 to T14) of the load threshold T, and the x coordinate of the work arm tip position and the work arm operation velocity v as the posture index values. The load threshold changing section 53A sets the load threshold T to T11 when the x coordinate of the work arm tip position is smaller than a boundary value α specified beforehand in a state that the work arm operation velocity v is lower than a reference velocity β specified beforehand. The load threshold changing section 53A sets the load threshold T to T13 when the x coordinate of the work arm tip position is equal to or larger than the boundary value α in the state that the work arm operation velocity v is lower than the reference velocity β. The load threshold changing section 53A sets the load threshold T to T12 when the x coordinate of the work arm tip position is smaller than the boundary value α specified beforehand in a state that the work arm operation velocity v is equal to or higher than the reference velocity β specified beforehand. The load threshold changing section 53A sets the load threshold T to T14 when the x coordinate of the work arm tip position is equal to or larger than the boundary value α in the state that the work arm operation velocity v is equal to or higher than the reference velocity β specified beforehand. For example, values such as the boundary value α, the reference velocity β, and the candidate values (T11 to T14) of the load threshold T specified in the load threshold table are determined based on an experiment result, a simulation result or the like.

Figure 14:
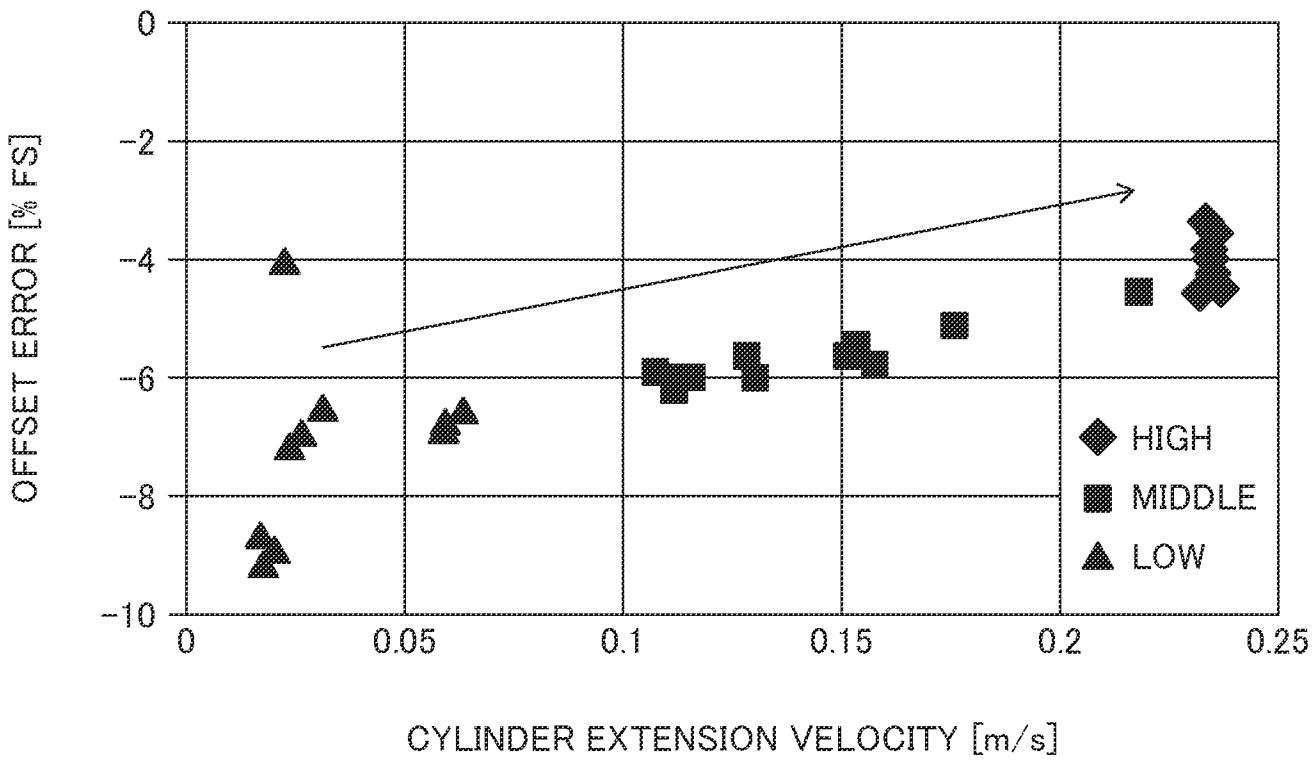
FIG. 14 is a diagram explaining an example of a method for specifying respective values in the load threshold table of Embodiment 2.

FIG. 14 is a diagram explaining an example of a method for specifying respective values in the load threshold table, illustrating a graph of a relation between a work arm operation velocity (an extension velocity of the boom cylinder 16), and load errors (differences between load values computed from detection values of the respective sensors 24 to 28, 38, and 39 and actual load values) in the case of an example of a hydraulic excavator having a bucket capacity of 0.8 $m^3$, when the relation is measured for each operation amount of the operation lever device 22 associated with the boom. It is understood that the relation illustrated in FIG. 14 is a substantially proportional relation. More specifically, an offset error during a fine operation (low velocity) of the operation lever device is approximately −8%, an offset error during a half-lever (middle velocity) is approximately −6%, and an error during a full-lever (high velocity) is approximately −4%. Accordingly, input beforehand for matching with the x coordinate of the work arm tip position are the boundary value α of 5 m, the reference velocity β of 0.15 m/s, the load threshold (candidate value) T11 of ±0.15-0.08 ton, the load threshold (candidate value) T12 of ±0.1-0.08 ton, the load threshold (candidate value) T13 of ±0.15-0.06 ton, and the load threshold (candidate value) T14 of ±0.1-0.06 ton. These values can be changed in accordance with purposes by an input of respective values of the load threshold table from the operator through the external input/output device 23.

Figure 15:
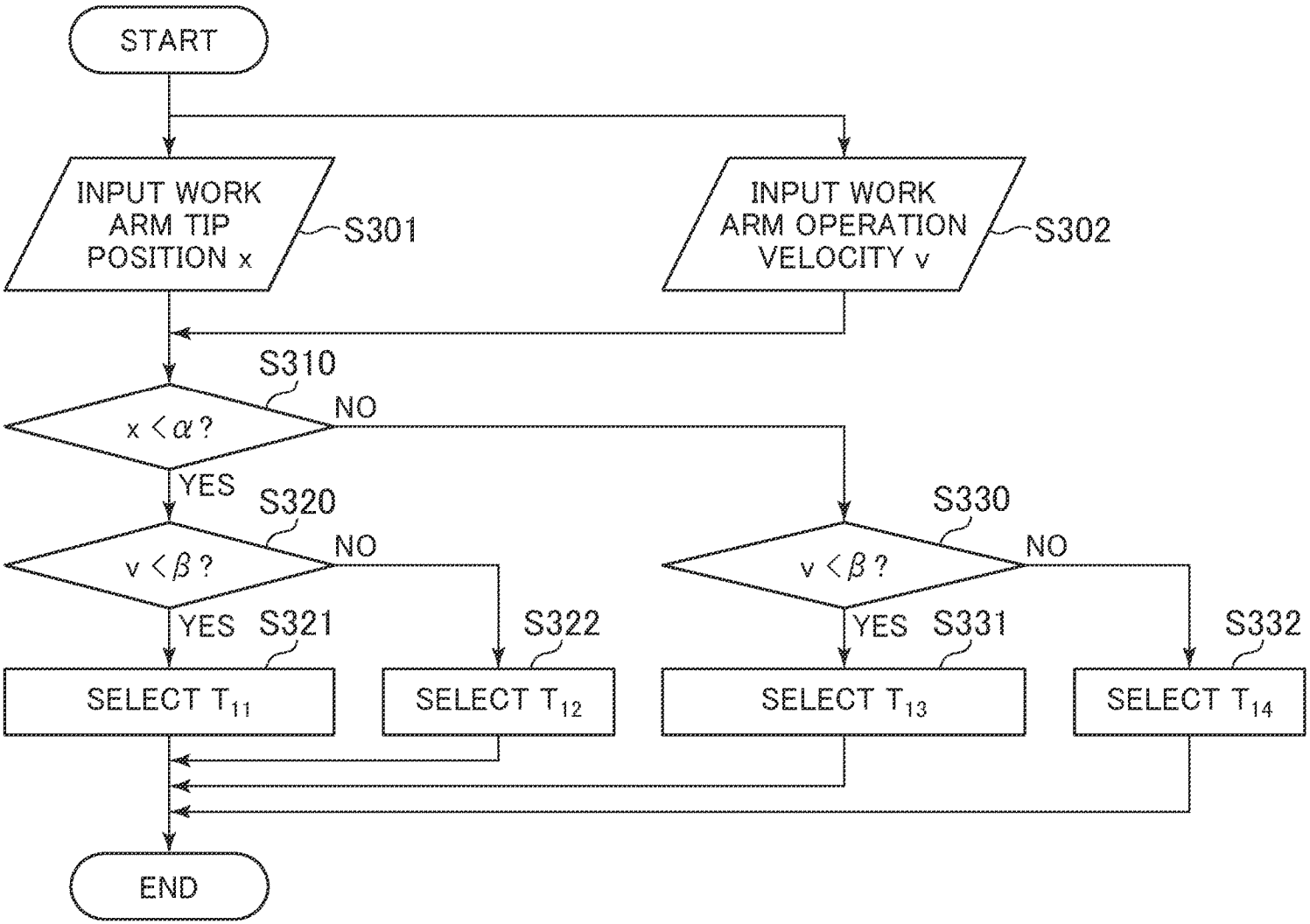
FIG. 15 is a flowchart representing the load threshold changing process performed by the load threshold changing section of Embodiment 2.

FIG. 15 is a flowchart representing the load threshold changing process performed by the load threshold changing section.

In a state that the x coordinate of the work arm tip position has been input as a calculation result of the work arm tip position calculation section 51 (step S301), and that the work arm operation velocity v has been input as a calculation result of the work arm operation velocity calculation section 56 (step S302), the load threshold changing section 53A determines whether or not the coordinate value x is smaller than the boundary value α specified in the load threshold table (step S310) in FIG. 15. When the determination result is YES, i.e., when the work arm tip position is located in a region at a distance shorter than a distance α from the origin O in the x axis direction in the x-y coordinate system, it is determined whether or not the work arm operation velocity v is lower than the reference velocity β (step S320). When the determination result is YES in step S320, the load threshold T is set to T11 (step S321). When the determination result is NO, the load threshold T is set to T12 (step S322). Thereafter, the process ends.

When the determination result is NO in step S310, i.e., when the work arm tip position is located in a region at a distance longer than the distance α from the origin O in the x axis direction in the x-y coordinate system, it is determined whether or not the work arm operation velocity v is lower than the reference velocity β (step S330). When the determination result is YES in step S330, the load threshold T is set to T13 (step S331). When the determination result is NO, the load threshold T is set to T14 (step S332). Thereafter, the process ends.

Other configurations are similar to the corresponding configurations in Embodiment 1.

Advantageous effects similar to those of Embodiment 1 can be offered in the present embodiment configured as above.

Moreover, the operation velocity of the front work implement (the extension velocity of the boom cylinder in this example) is used at the time of a change of the load threshold T as well as the tip position of the front work implement. In this case, not only a difference in load measuring accuracy produced by the posture during load measurement, but also a difference in load measuring accuracy produced by the operation can be taken into consideration. Accordingly, deterioration of measuring accuracy can be more accurately detected.

According to the present embodiment described by way of example, two regions are set in the x coordinate using the boundary value α, and two regions are set in the work arm operation velocity v using the reference velocity β. However, the numbers of the set regions are not limited to these numbers, but may be three or more to set necessary regions.

Embodiment 3

Embodiment 3 of the present invention will be described with reference to FIGS. 16 to 17. Only differences between the present embodiment and Embodiment 1 will be described. Components similar to the corresponding components of Embodiment 1 in the figures referred to in the present embodiment are given similar reference characters, and the same explanation is not repeated.

In Embodiment 1, the load threshold table set by the load threshold setting section 52 and used by the load threshold changing section 53 specifies the relation between the plurality of candidate values of the load threshold T and the x coordinate of the work arm tip position as the posture index value. In the present embodiment, however, a load threshold table which continuously specifies the relation between the posture index value and the load threshold is used to change the load threshold.

Figure 16:
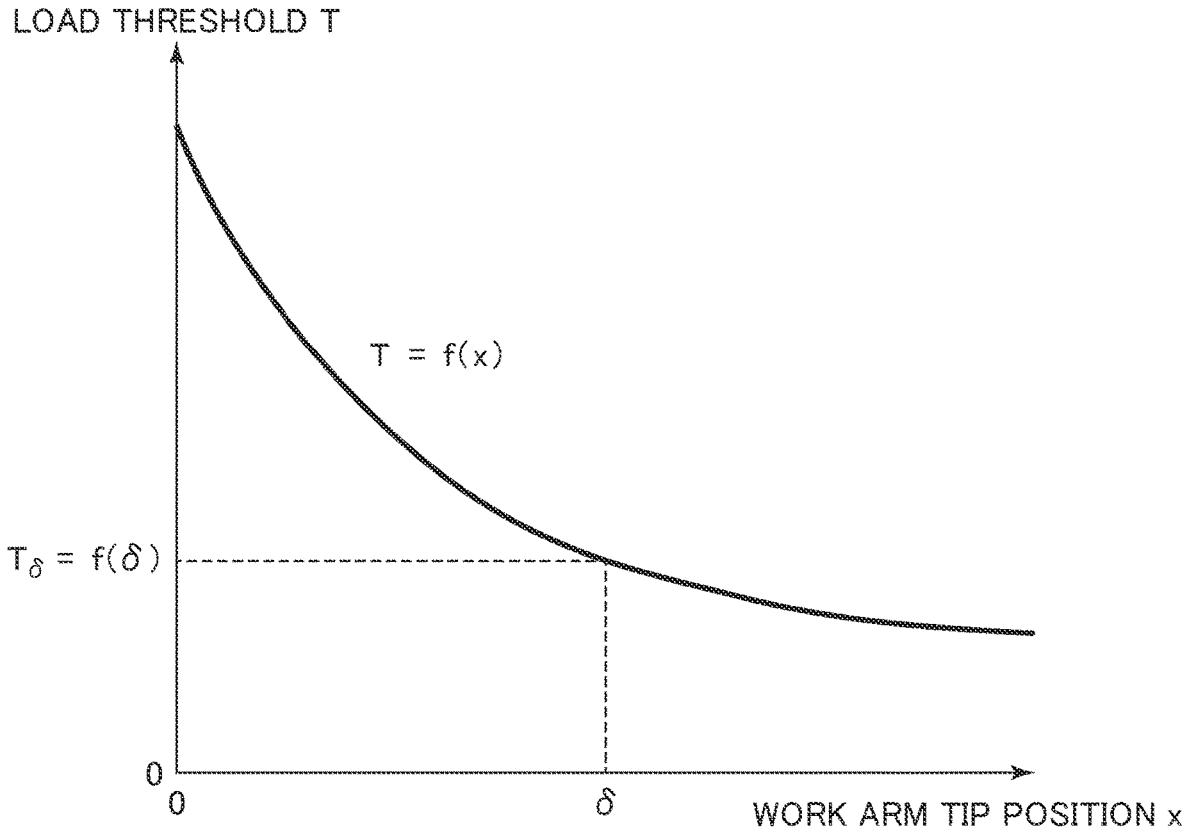
FIG. 16 is a diagram illustrating an example of a load threshold table set by a load threshold setting section of Embodiment 3, and used for a load threshold changing process performed by a load threshold changing section.

FIG. 16 is a diagram illustrating an example of the load threshold table set by the load threshold setting section, and used for a load threshold changing process performed by the load threshold changing section.

As illustrated in FIG. 16, the load threshold table of the present embodiment specifies a relation between the load threshold T and the x coordinate of the work arm tip position as the posture index value using a continuous function T=f(x). The function T=f(x) is set such that T increases as the x coordinate decreases in consideration that measuring accuracy in principle deteriorates as the work arm tip position approaches the rotation axis of the boom 13, i.e., as the x coordinate of the work arm tip position decreases. The load threshold changing section 53 sets the load threshold T such that T=f(δ)=Tδ when the x coordinate of the work arm tip position corresponding to the calculation result of the work arm tip position calculation section 51 is δ, for example. The function f(x) specified in the load threshold table is determined based on an experiment result or a simulation result, for example.

As described with reference to FIG. 6 of Embodiment 1, a deviation of the load lies within ±10% full-scale (hereinafter referred to as F. S.) when the x coordinate of the work arm tip position is equal to or larger than approximately ½ of the maximum value. When the x coordinate of the work arm tip position is equal to or smaller than approximately ½ of the maximum value, the deviation of the load lies approximately in a range of ±15% F. S. as a result of deterioration of accuracy. The deviation of the load slightly decreases when the x coordinate of the work arm tip position is close to the maximum value. The relation between the horizontal distance and the load error can be approximated as a quadratic function. Accordingly, the function T=f(x) can be expressed by following (Equation 10) assuming that deviations of the load are ±15% F. S., ±10% F. S., and ±8% F. S. at the time of the x coordinate of 0 m, the x coordinate of 5 m, and the x coordinate of 10 m, respectively, in a work machine having the maximum value of 10 m for the x coordinate of the work arm tip position and F. S. of 1.0 ton for simplifying calculation.

$$T=f(x)=0.6x2-13x+0.15 \quad \text{(Equation 10)}$$

These values can be changed in accordance with purposes by an input of respective values of the load threshold table from the operator through the external input/output device 23.

Figure 17:
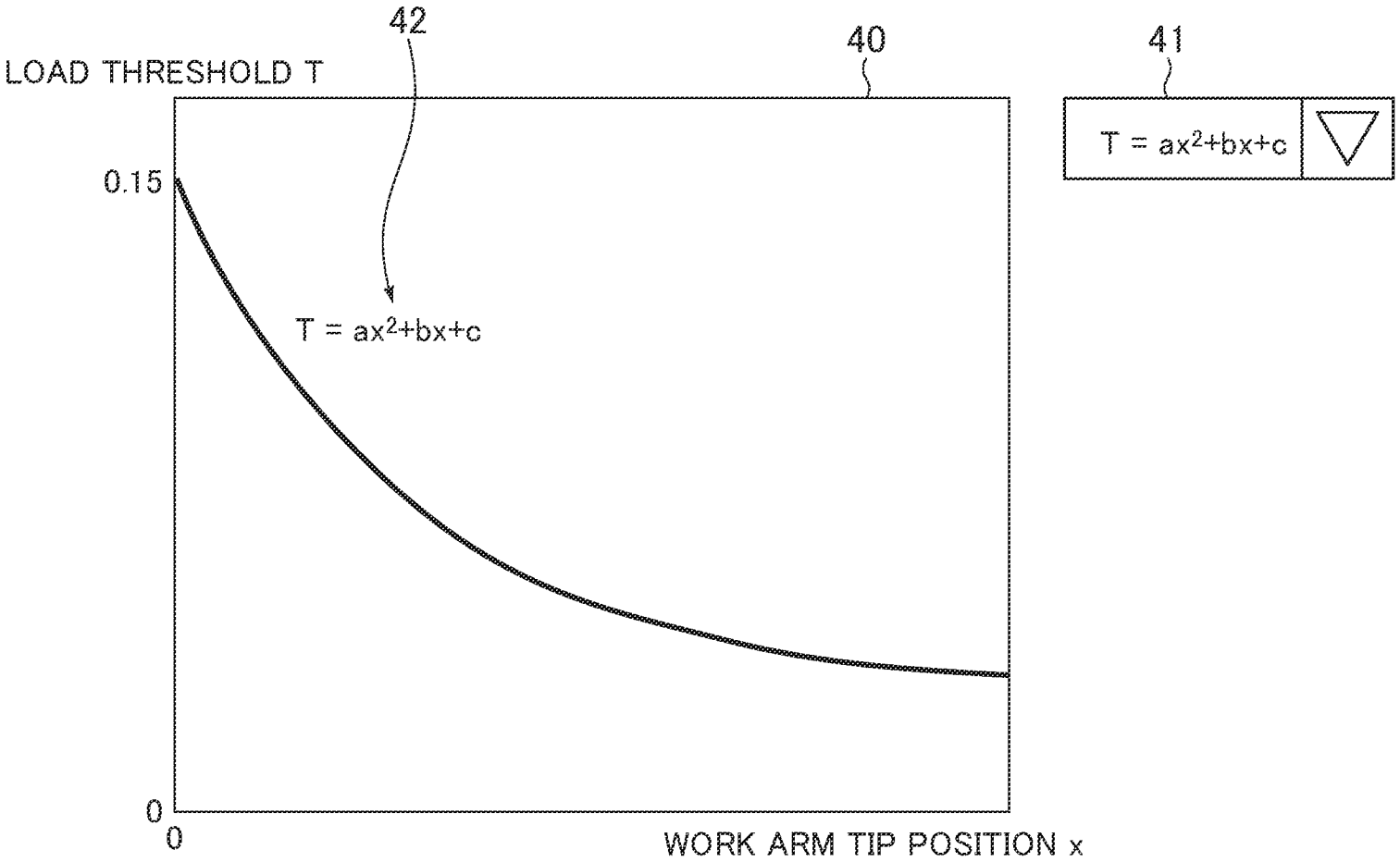
FIG. 17 is a diagram illustrating an example of a threshold setting screen called in response to a touch at a threshold button of a determination mode in a display screen of an external input/output device of Embodiment 3.

FIG. 17 is a diagram illustrating an example of a threshold setting screen called by a touch of a threshold button of a determination mode in the display screen of the external input/output device.

FIG. 17 depicts a threshold setting screen called when selected by a touch at the threshold button 32 of the determination mode in the display screen 30 of the external input/output device 23 for changing the settings of the load threshold table or the respective values of the load threshold table, illustrating a graph display portion 40 which displays a function specified in the load threshold table, and a drop down list 41 which selectively sets a function used as the load threshold table from a plurality of functions determined beforehand. According to the example illustrated in FIG. 17, the graph display portion 40 has a vertical axis representing the load threshold T, and a horizontal axis representing the x coordinate of the work arm tip position. A value of 0.15 ton as an intercept of the function T=f(x) is displayed on the vertical axis, while a range up to the maximum value of the x coordinate of the work arm tip position computed from design values of the mechanism, the size and the like of the hydraulic excavator is displayed on the horizontal axis. The graph display portion 40 further displays a function set as the load threshold table (e.g., a function 42 in FIG. 17). A plurality of model functions are registered in the drop down list 41. An appropriate model function is selected as the load threshold table by touching the drop down list 41. An initial value of a coefficient is set for each of the model functions beforehand. The value of the coefficient can be changed using the numeric keys 31 in an input state produced by touching the function 42 displayed on the graph display portion 40. For example, FIG. 17 illustrates a case which selects, as the load threshold table, a quadratic function $T=f(x)=ax^2+bx+c$ to which coefficients a, b, and c have been input as initial values.

Other configurations are similar to the corresponding configurations in Embodiment 1.

Advantageous effects similar to those of Embodiment 1 can be offered in the present embodiment configured as above.

Moreover, the load threshold T is configured to continuously change in accordance with the posture index value (the x coordinate of the work arm tip position). Accordingly, deterioration of measuring accuracy can be more accurately detected than in a case which discretely changes the load threshold T.

According to the present embodiment, the function represented by a curve having no inflection point is used as the function T=f(x) of the load threshold T by way of example. However, other functions such as a linear function, and a function represented by a curve having an inflection point like a sigmoid curve may be adopted. However, it is preferable that an experiment result obtained by measuring the relation between the actual load error and the posture is used as a reference in selecting the function of the load threshold T.

Embodiment 4

Embodiment 4 of the present invention will be described with reference to FIGS. 18 to 20. Only differences between the present embodiment and Embodiment 1 will be described. Components similar to the corresponding components of Embodiment 1 in the figures referred to in the present embodiment are given similar reference characters, and the same explanation is not repeated.

According to the present embodiment, an average of the x coordinates of the work arm tip position in a certain fixed period in Embodiment 1 is designated as a posture index value. A reevaluation determination process is performed based on the load threshold T obtained by this posture index value, and an average of the load values W in a certain fixed period.

Figure 18:
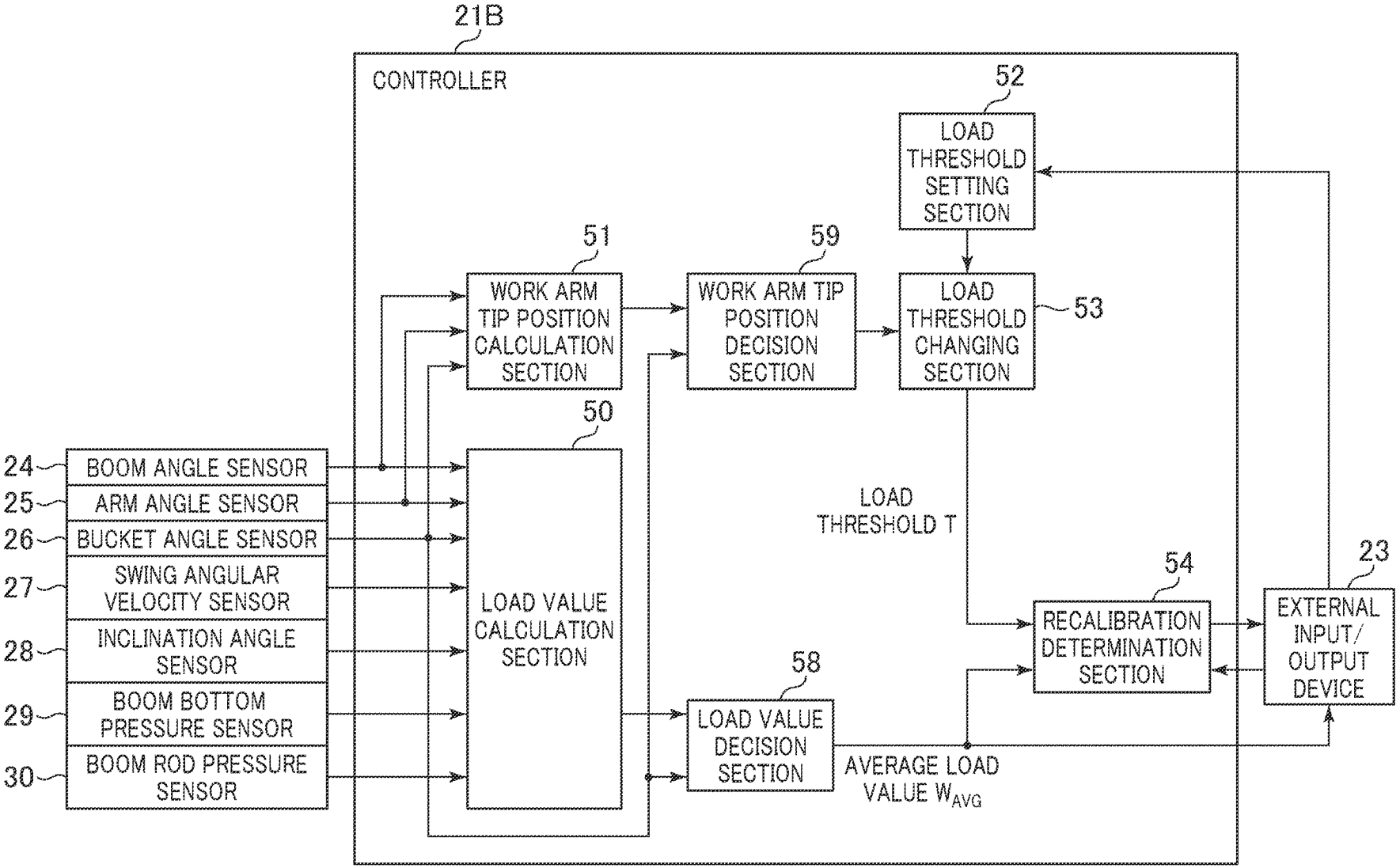
FIG. 18 is a functional block diagram schematically illustrating a configuration associated with a load measuring system including a controller according to Embodiment 4.

FIG. 18 is a functional block diagram schematically illustrating a configuration associated with a load measuring system including a controller.

In FIG. 2, a controller 21B includes: the load value calculation section 50 which calculates a load value as a weight of a transportation target (e.g., excavated object such as soil) carried by the bucket 15 of the front work implement 12 based on detection results of the work load sensors (the boom bottom pressure sensor 38 and the boom rod pressure sensor 39) and detection results of the posture information sensors (the boom angle sensor 24, the arm angle sensor 25, the bucket angle sensor 26, the swing angular velocity sensor 27, and the inclination angle sensor 28); a load value decision section 58 which computes an average of load values as calculation results of the load value calculation section 50 in a certain period based on a detection result of the bucket angle sensor 26, and outputs the average as a decision value of the load value; the work arm tip position calculation section 51 which calculates a tip position of the front work implement 12 (i.e., tip position of the bucket 15, hereinafter referred to as a work arm tip position) as a posture index value which is an index concerning a posture of the front work implement 12 based on detection results of the posture information sensors (the boom angle sensor 24, the arm angle sensor 25, and the bucket angle sensor 26); a work arm tip position decision section 59 which computes an average of the x coordinates of the work arm tip position as calculation results of the work arm tip position calculation section 51 in a certain period based on a detection result of the bucket angle sensor 26, and outputs the average as a decision value of the work arm tip position; the load threshold setting section 52 which sets a load threshold table determining beforehand a relation between posture index values and a plurality of candidate values of a load threshold used for determining whether to recalibrate the load measuring system based on settings input by the operator through the external input/output device 23; the load threshold changing section 53 which changes the load threshold in accordance with the load threshold table set by the load threshold setting section 52 and a calculation result of the work arm tip position calculation section 51; and the recalibration determination section 54 which determines whether to recalibrate the load measuring system based on the load threshold received from the load threshold changing section 53 and a calculation result obtained by the load value calculation section 50 in an unladen state where no transportation target is present on the bucket 15 when an instruction of a start of a recalibration determination process is issued from the operator via the external input/output device 23, and notifies the operator of a determination result by displaying the determination result on a function section of the external input/output device 23 as a display device. The respective processes are performed by the controller 21B in accordance with a sampling time set beforehand.

It is assumed that the boom angle sensor 24, the arm angle sensor 25, and the bucket angle sensor 26 of the present embodiment are each constituted by an inertial measurement unit (IMU) for measuring an angular velocity and an acceleration, and are capable of detecting absolute angles (angles with respect to the horizontal plane) of the boom 13, the arm 14, and the bucket 15, respectively. Relative angles of the boom 13, the arm 14, the bucket 15, and the upper swing structure 11 are computed and used based on detection values of these sensors and the inclination angle sensor 28. Alternatively, the respective relative angles of the boom 13, the arm 14, and the bucket 15 detected by the boom angle sensor 24, the arm angle sensor 25, and the bucket angle sensor 26 may be input to each of the load value decision section 58 and the work arm tip position decision section 59 to compute the absolute angle of the bucket 15 based on these values.

Figure 19:
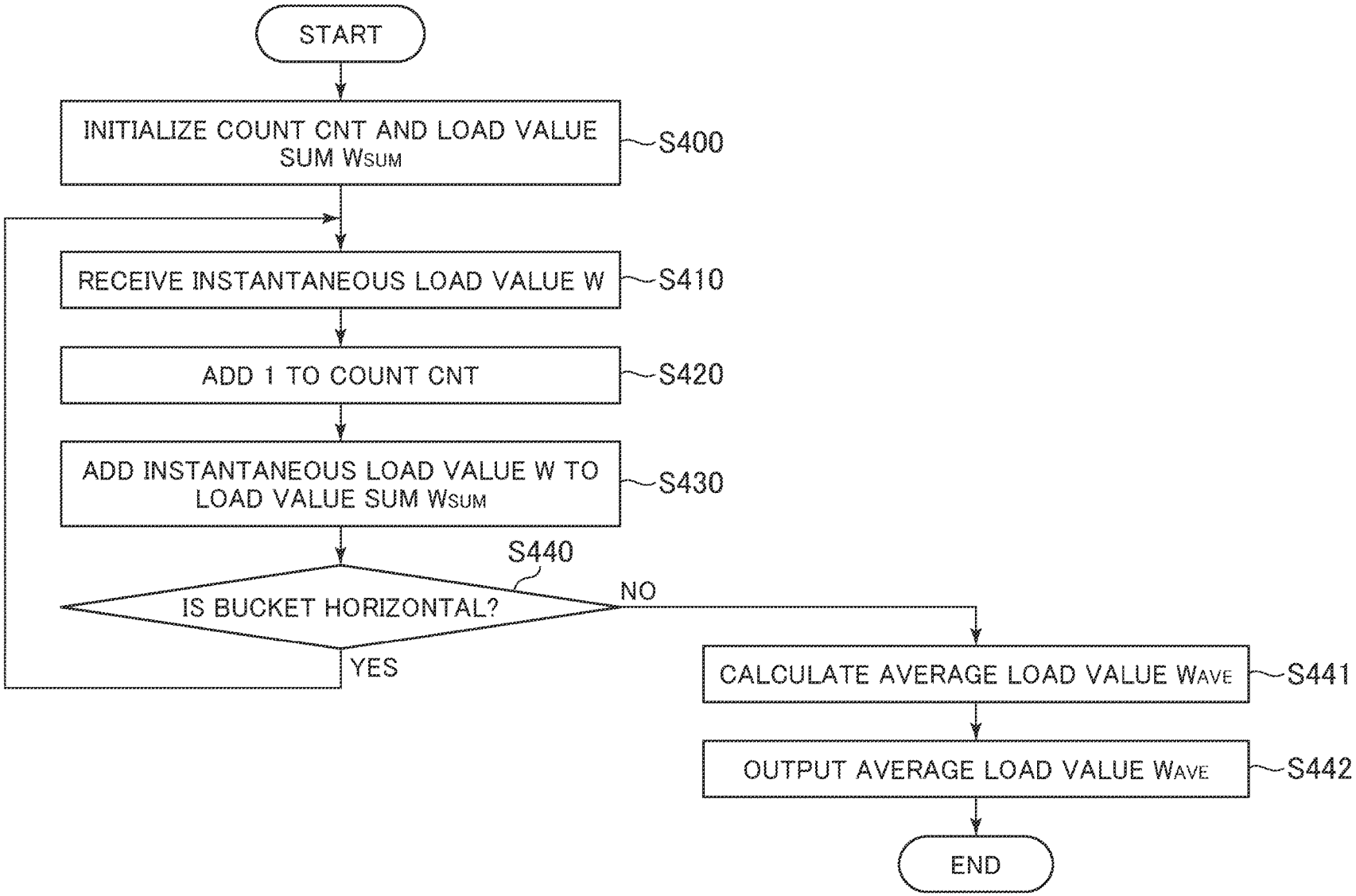
FIG. 19 is a flowchart representing a load value decision process performed by a load value decision section of Embodiment 4.

FIG. 19 is a flowchart representing a load value decision process performed by the load value decision section.

In FIG. 19, the load value decision section 58 first initializes a count CNT which is a variable indicating the number of reception of the load value W as a calculation result of the load value calculation section 50 (sampling number), and a load value sum WSUM which is a variable indicating the sum of the load values W (step S400). Subsequently, the load value W calculated by the load value calculation section 50 (particularly referred to as an instantaneous load value W herein) is received (step S410), and 1 is added to the value of the count CNT (step S420). In addition, the instantaneous load value W is added to the load value sum WSUM (step S430). It is determined herein whether or not the bucket 15 is horizontal, i.e., whether or not a detection result of the bucket angle sensor 26 lies in a range of values based on which the bucket 15 is considered to be horizontal (step S440). When the determination result is YES, processing from steps S410 to S430 is repeated. When the determination result in step S440 is NO, an average load value WAVG is calculated from the load value sum WSUM and the count CNT using following (Equation 11) (step S441). Thereafter, the average load value WAVG is output to the recalibration determination section 54 and the external input/output device 23 (step S442), and the process ends.

$$WAVG = WSUM/CNT \quad \text{(Equation 11)}$$

Figure 20:
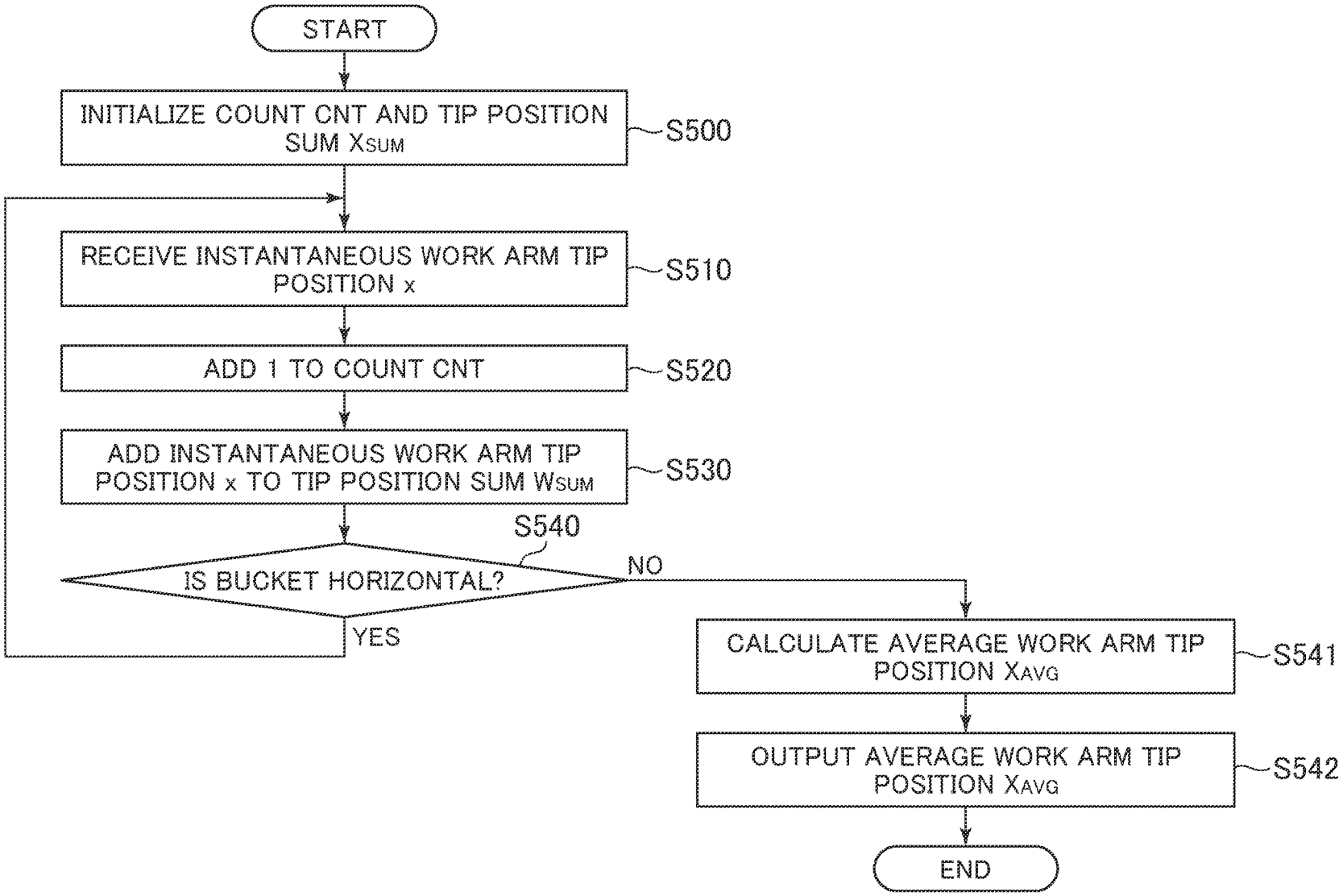
FIG. 20 is a flowchart representing a work arm tip position decision process performed by a work arm tip position decision section of Embodiment 4.

FIG. 20 is a flowchart representing a work arm tip position decision process performed by the work arm tip position decision section.

In FIG. 20, the work arm tip position decision section 59 first initializes a count CNT which is a variable indicating the number of reception of the x coordinate of the work arm tip position (hereinafter referred to as work arm tip positions x) as a calculation result of the work arm tip position calculation section 51 (sampling number), and a tip position sum XSUM which is a variable indicating the sum of the work arm tip positions x (step S500). Subsequently, the work arm tip position x calculated by the work arm tip position calculation section 51 (particularly referred to as an instantaneous work arm tip position x herein) is received (step S510), and 1 is added to the value of the count CNT (step S520). In addition, the instantaneous work arm tip position x is added to the tip position sum XSUM (step S530). It is determined herein whether or not the bucket 15 is horizontal, i.e., whether or not a detection result of the bucket angle sensor 26 lies in a range of values based on which the bucket 15 is considered to be horizontal (step S540). When the determination result is YES, processing from steps S510 to S530 is repeated. When the determination result in step S540 is NO, an average work arm tip position XAVG is calculated from the tip position value sum XSUM and the count CNT using following (Equation 12) (step S541). Thereafter, the average work arm tip position XAVG is output to the load threshold changing section 53 as a posture index value (step S542), and the process ends.

$$XAVG = XSUM/CNT \quad \text{(Equation 12)}$$

The load threshold changing section 53 receives the output from the work arm tip position decision section 59 as the posture index value of the front work implement 12, and changes the load threshold in accordance with the load threshold table set by the load threshold setting section 52 and the posture index value. The average work arm tip position XAVG as the posture index value input to the load threshold changing section 53 is a value of the same dimension as the dimension of the work arm tip position x in Embodiment 1. Accordingly, the load threshold changing section 53 performs processing similarly to Embodiment 1. When an instruction of a start of the recalibration determination process is issued from the operator via the external input/output device 23, the recalibration determination section 54 determines whether to perform recalibration of the load measuring system based on an output from the load value decision section 58 (the average load value WAVG) in an unladen state where no transportation target is present in the bucket 15, and the load threshold T received from the load threshold changing section 53, and displays a determination result on the function section of the external input/output device 23 as a display device to notify the operator of the determination result. The average load value WAVG input to the recalibration determination section 54 is also a value of the same dimension as that of the work arm tip position x of Embodiment 1. Accordingly, the load threshold changing section 53 performs processing similarly to Embodiment 1.

Other configurations are similar to the corresponding configurations in Embodiment 1.

Advantageous effects similar to those of Embodiment 1 can be offered in the present embodiment configured as above.

The count CNT in the load value decision process performed by the load value decision section 58 and the count CNT in the work arm tip position decision process performed by the work arm tip position decision section 59 are substantially identical values, and average the instantaneous load values W and the instantaneous work arm tip positions x in the same period, respectively. Accordingly, the average work arm tip position XAVG to be obtained is an average value in the same predetermined period as the period of calculation of the average load value WAVG. More specifically, a change of the load threshold T and a recalibration determination are made using averages of the load value W and the work arm tip position x in the predetermined period. Accordingly, erroneous detections or outliers of the respective sensors do not easily affect calculation of the load value W and the work arm tip position x of Embodiment 1, wherefore the respective values are more robustly detectable.

According to the present embodiment described by way of example, the timing of computation of averages of the load value and the work arm tip position is determined based on the absolute angle of the bucket 15. However, this determination may be made based on other factors, such as a height of the work arm tip position (y coordinate).

Embodiment 5

Embodiment 5 of the present invention will be described with reference to FIGS. 21 to 23. Only differences between the present embodiment and Embodiment 1 will be described. Components similar to the corresponding components of Embodiment 1 in the figures referred to in the present embodiment are given similar reference characters, and the same explanation is not repeated.

It is assumed that the bucket 15 performs the recalibration determination process in the unladen state in Embodiment 1. According to the present embodiment, however, the recalibration determination process is performed in a state that the transportation target having a known load value is carried on the bucket 15.

Figure 21:
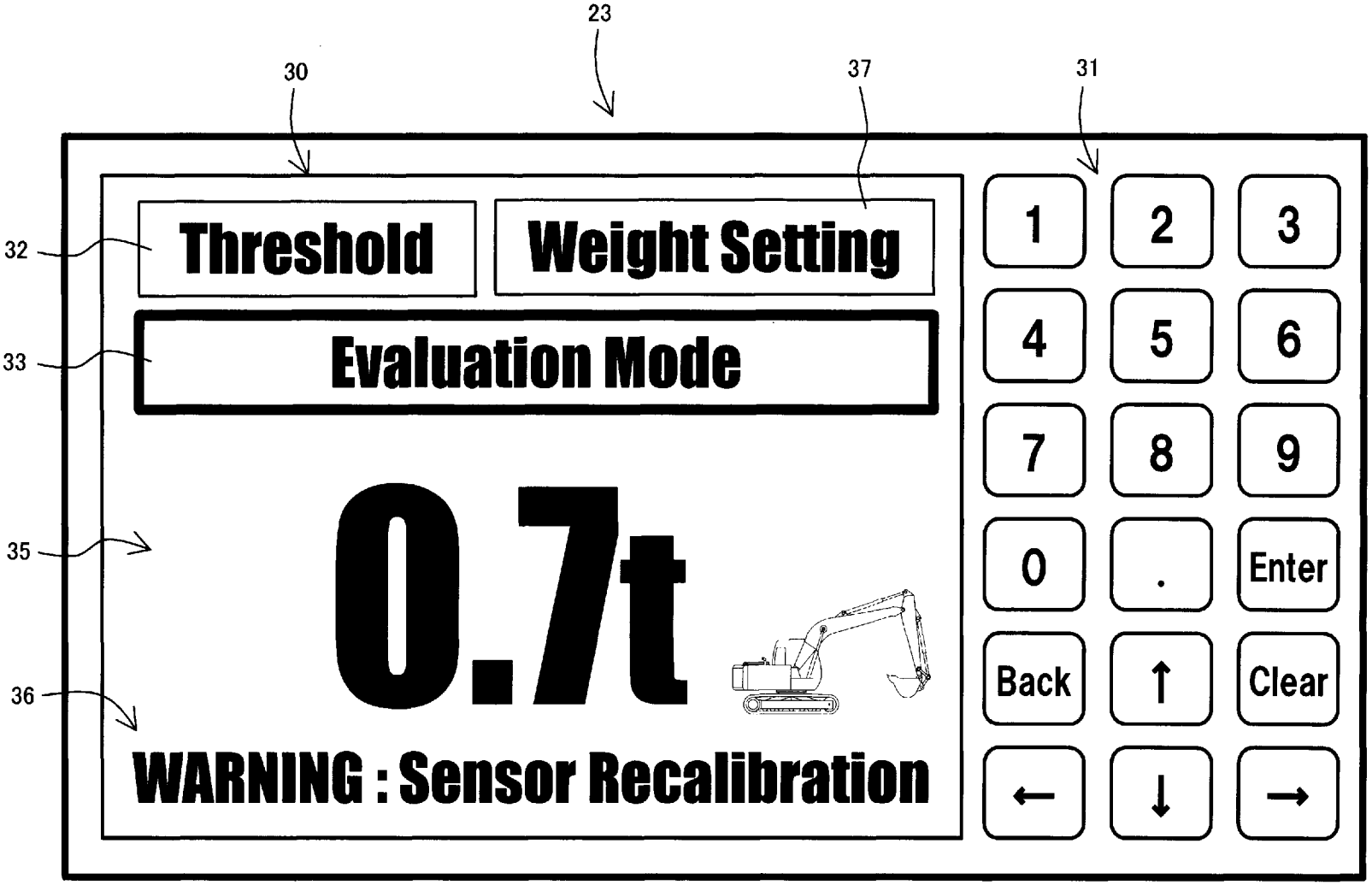
FIG. 21 is a view schematically illustrating an external input/output device and a display example of the external input/output device according to Embodiment 5, as a view illustrating a display example of a determination result of a recalibration determination process.

FIG. 21 is a view schematically illustrating an external input/output device and a display example of the external input/output device according to the present embodiment, as a view illustrating a display example of a determination result of the recalibration determination process.

As illustrated in FIG. 21, the external input/output device 23 includes the display screen 30 of a touch panel type having a function as a display device and a function as an operation device, and the numeric keys 31 (including various function keys such as a direction key, a decision key, a cancel key, and a back key, hereinafter collectively and simply referred to as numeric keys) having a function as an operation device/input device.

In FIG. 21, an outer periphery of the determination mode button 33 is displayed with highlight to indicate a switchover to the mode performing the recalibration determination process in response to a touch by the operator at the determination mode button 33. Moreover, FIG. 21 depicts a state where a determination result of the recalibration determination process is displayed in the display screen 30, illustrating the determination mode button 33, the threshold button 32, and also a "Weight Setting" button (load true value setting button) 37 for calling a screen for setting a load true value WT, the load value display portion 35 for displaying a measurement result of the load value W, and the message display portion 36 for displaying a message corresponding to the determination result. The example in FIG. 21 illustrates a case where −0.7 [t] is displayed in the load value display portion 35 as the measurement result of the load value W, with display of a message urging recalibration of the load measuring system in the message display portion 36 in correspondence with a determination that recalibration is necessary by the recalibration determination process. A current setting value of the load true value WT is displayed in the display screen 30 in response to a touch at the load true value setting button 37 of the display screen 30. In this case, an input state is produced by touching a display portion of the load true value WT, and then a load value of the transportation target carried on the bucket 15 (i.e., a known weight for load value calibration) is input using the numeric keys 31. Thereafter, the "Enter" key of the numeric keys 31 is pressed to decide the input.

Figure 22:
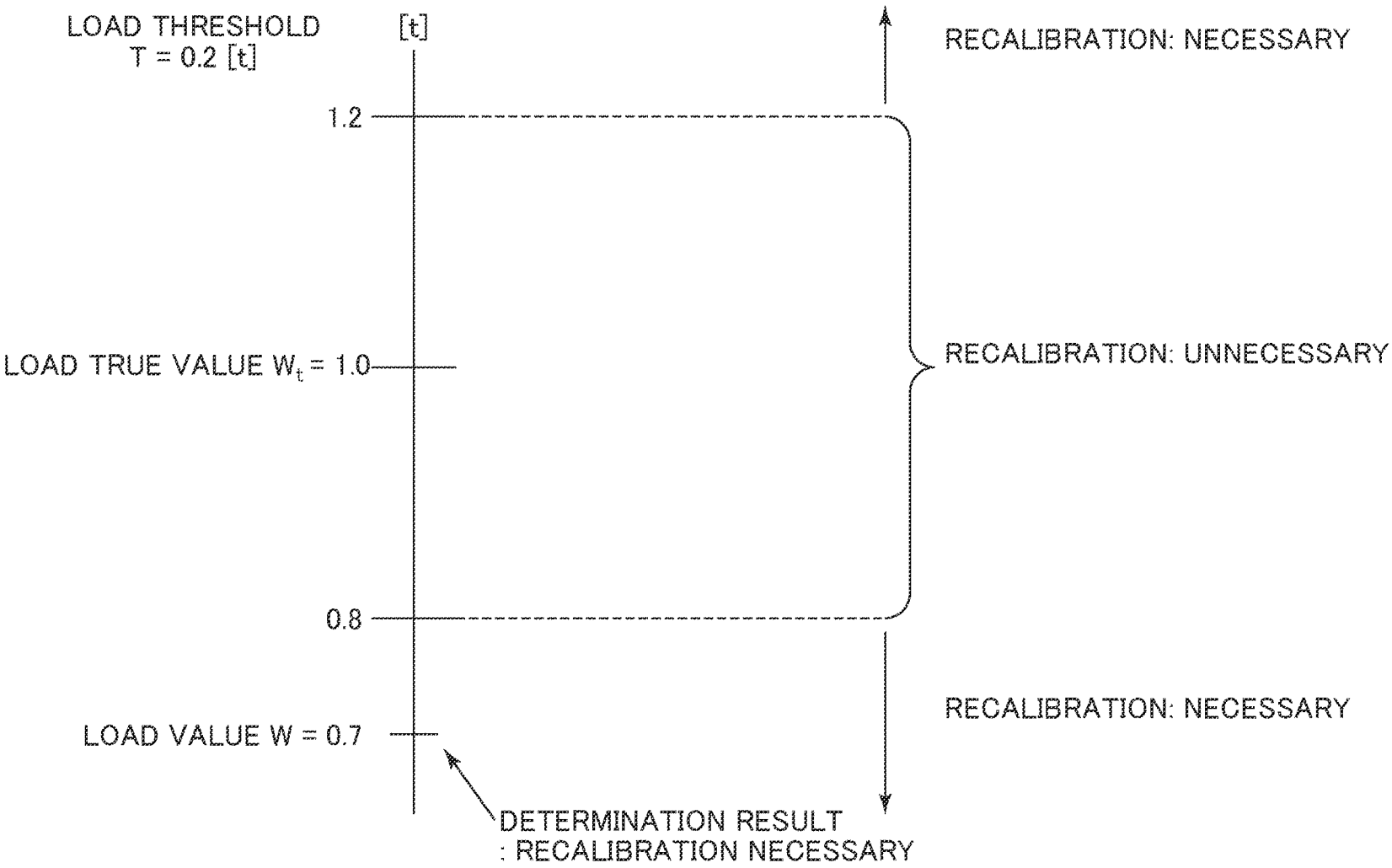
FIG. 22 is a diagram illustrating a concept of a recalibration determination process performed by a recalibration determination section of Embodiment 5.

FIG. 22 is a diagram illustrating a concept of a recalibration determination process performed by the recalibration determination section of the present embodiment.

In FIG. 22, 0.7 [t] has been input from the load value calculation section 50 to the recalibration determination section 54 as the load value W in a state that a weight for calibration (e.g., weight having a known load value of 1.0 [t]) is carried by the bucket 15, and 0.2 [t] has been input from the load threshold changing section 53 to the recalibration determination section 54 as the load threshold T. The load threshold T in the recalibration determination section 54 specifies a width of a range in the positive-negative direction around 1.0 [t] which is the load value of the weight for calibration (the load true value WT). When the load value W in the state where the weight for calibration is carried on the bucket 15 is present inside (not including the boundary) of a region specified by the load threshold T, the recalibration determination section 54 determines that recalibration of the load measuring system is unnecessary. When the load value W in the unladen state is present outside (including the boundary) of the region specified by the load threshold T, the recalibration determination section 54 determines that recalibration of the load measuring system is necessary.

For example, when the load threshold T is 0.2 [t] as illustrated in FIG. 22, the load threshold T specifies a range of 0.2 [t] both in the positive direction and in the negative direction from 1.0 [t] which is the load true value WT. When the load value W is 0.7 [t] in this case, the recalibration determination section 54 determines that recalibration is necessary.

Figure 23:
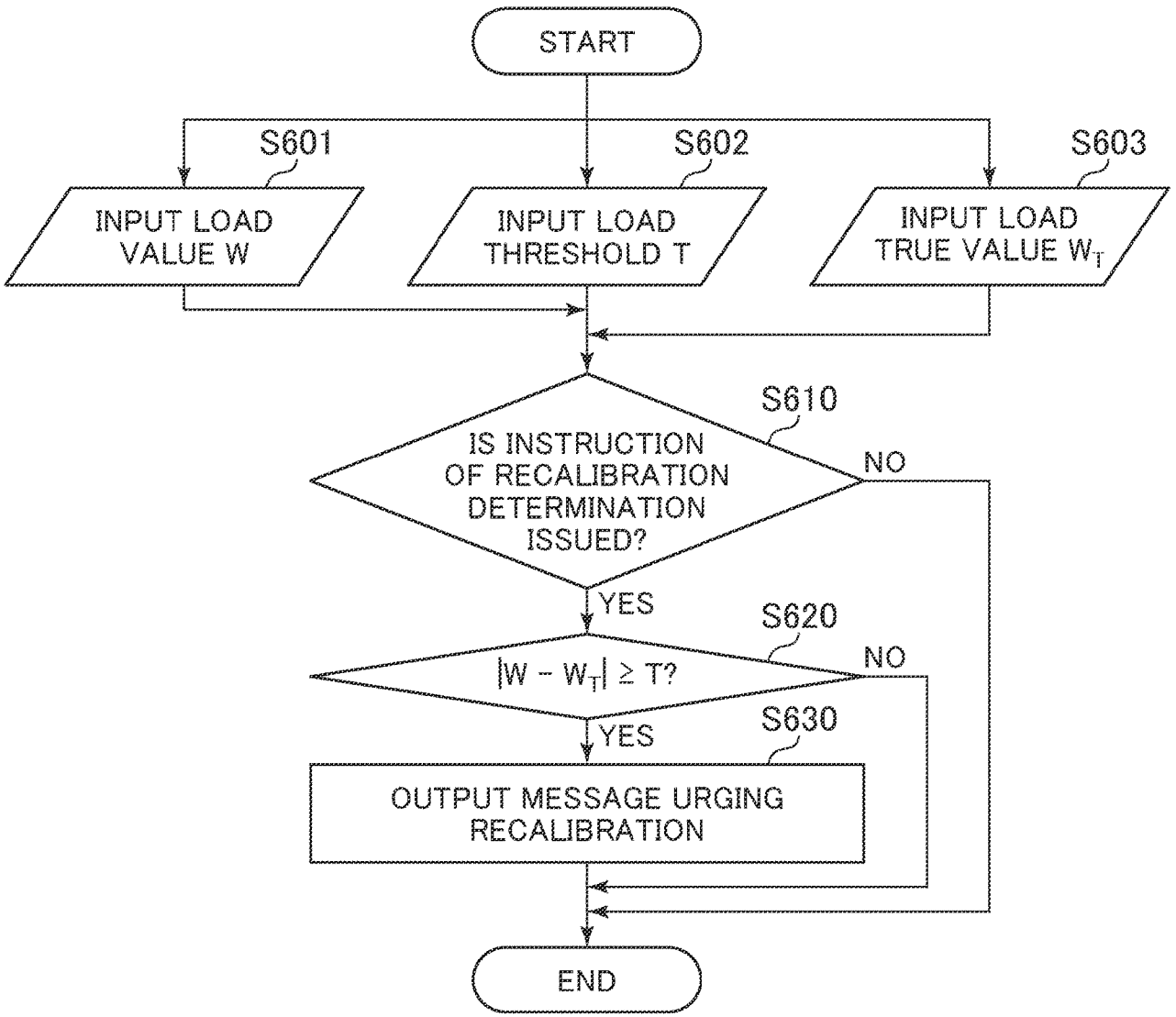
FIG. 23 is a flowchart representing the recalibration determination process performed by the recalibration determination section of Embodiment 5.

FIG. 23 is a flowchart representing the recalibration determination process performed by the recalibration determination section of the present embodiment.

In FIG. 23, the recalibration determination section 54 determines whether or not an instruction of a start of the recalibration determination process has been issued (step S610) in a state that the load value W has been input as a calculation result of the load value calculation section 50 (step S601), that the load threshold T has been input from the load threshold changing section 53 (step S602), and that the load true value WT has been input from the external input/output device 23 (step S603). When the determination is YES, it is determined whether or not an absolute value of a difference between the load value W and the load true value WT (|W−WT|) is the load threshold T or larger (step S620). When the determination result is YES in step S620, a message urging recalibration is displayed as the determination result on the display screen 30 of the external input/output device 23 to notify the operator of the determination result (step S630). Thereafter, the process ends.

When at least either one of the determination results in steps S610 and S620 is NO, the process ends.

Other configurations are similar to the corresponding configurations in Embodiment 1.

Advantageous effects similar to those of Embodiment 1 can be offered in the present embodiment configured as above.

Moreover, in the recalibration determination process, it is determined that recalibration is necessary when the difference between the true value of the load carried by the bucket 15 of the front work implement 12 (load true value WT) and the load value W is the load threshold T or larger. Accordingly, only the load true value WT needs to be input even when the value of the weight for calibration changes, wherefore usability of the recalibration determination process improves.

Characteristics of the respective embodiments will be next described.

(1) According to the embodiments described above, a work machine (e.g., the hydraulic excavator 100) includes: a machine body (e.g., the upper swing structure 11); the front work implement 12 that is an articulated type, is attached to the machine body, and includes a plurality of front members (e.g., the boom 13, the arm 14, and the bucket 15) rotatably connected to each other; a plurality of hydraulic actuators (e.g., the boom cylinder 16) that respectively drive the plurality of front members of the front work implement in accordance with operation signals; a load measuring system that includes a work load sensor (e.g., the boom bottom pressure sensor 38 and the boom rod pressure sensor 39) detecting work loads of the hydraulic actuators, a plurality of posture information sensors (e.g., the boom angle sensor 24, the arm angle sensor 25, the bucket angle sensor 26, the swing angular velocity sensor 27, and the inclination angle sensor 28) detecting posture information that is information associated with respective postures of the plurality of front members and the machine body, and a controller (e.g., the controller 21) calculating a load value as a weight of a transportation target carried by the front work implement based on detection results obtained by the work load sensor and the posture information sensors; and a display device (e.g., the display screen 30) disposed inside the cab 20 boarded by an operator. The controller is capable of changing a load threshold used for determining whether to recalibrate the load measuring system in accordance with a posture index value that is an index concerning a posture of the front work implement and obtained based on the detection results of the posture information sensors. The controller determines whether to recalibrate the load measuring system based on a calculation result of the load value and the changed load threshold, and displays a determination result on the display device.

In this case, deterioration of measuring accuracy is more appropriately detectable regardless of variations of the posture of the front work implement of the work machine.

(2) According to the embodiments described above, in the work machine according to (1), the controller calculates, as the posture index value of the front work implement, a position of a tip of the front work implement in a vehicle coordinate system set beforehand for the machine body, the position being calculated based on the detection results of the plurality of posture information sensors. The controller changes the load threshold in accordance with the position of the tip of the front work implement, the position having been calculated as the posture index value.

(3) According to the embodiments described above, in the work machine according to (1), the controller calculates, as the posture index value, a shift velocity of a tip of the front work implement in a vehicle coordinate system set beforehand for the machine body, the shift velocity being calculated based on the detection results of the plurality of posture information sensors. The controller changes the load threshold in accordance with the shift velocity of the tip of the front work implement, the shift velocity having been calculated as the posture index value.

(4) According to the embodiments described above, in the work machine according to any one of (1), the controller selectively changes the load threshold to any one of a plurality of candidate values in accordance with the posture index value.

(5) According to the embodiments described above, in the work machine according to any one of (1), the controller changes the load threshold in accordance with the posture index value by determining the load threshold corresponding to the posture index value with reference to a load threshold table that continuously determines a relation between the posture index value and the load threshold.

(6) According to the embodiments described above, in the work machine according to any one of (1), the controller calculates an average of the posture index values in a period determined beforehand, and changes the load threshold in accordance with a calculation result of the average of the posture index values. The controller calculates an average of the load values in a period determined beforehand, and determines whether to recalibrate the load measuring system based on a calculation result of the average of the load values and the changed load threshold.

(7) According to the embodiments described above, in the work machine according to any one of (1), the controller sets, as a load true value, a true value of a load value that is a weight of the transportation target carried by the front work implement. The controller determines whether to recalibrate the load measuring system based on a difference between the load true value and the load value, and on the load threshold.

<Additional Statement>

In the embodiments described above, the ordinary hydraulic excavator which uses a prime mover such as an engine for driving the hydraulic pump has been presented by way of example. Needless to say, the present invention is applicable to a hybrid type hydraulic excavator which drives a hydraulic pump using an engine and a motor, an electrically-powered hydraulic excavator which drives a hydraulic pump using only a motor, and others.

According to the present embodiments, the hydraulic excavator has been described as an example of the work machine. However, the present invention is applicable to a work machine which includes a moving section on a work arm for varying a work range, such as a crane.

The present invention is not limited to the embodiments described above, but include various modifications and combinations without departing from the subject matters of the present invention. The present invention is not limited to a mode including all the configurations described in the above embodiments, but includes a mode which eliminates a part of the configurations. A part or all of the respective configurations, functions and the like described above may be implemented by integrated circuits designed for those, for example. In addition, the respective configurations, functions and the like described above may be implemented as software by using a processor which interprets and executes a program achieving the respective functions.

DESCRIPTION OF REFERENCE CHARACTERS

7*a*, 7*b*: Crawler

8*a*, 8*b*: Traveling hydraulic motor

9*a*, 9*b*: Crawler frame
10: Lower track structure
11: Upper swing structure
12: Front work implement
13: Boom
14: Arm
15: Bucket
16: Boom cylinder
17: Arm cylinder
18: Bucket cylinder
19: Swing hydraulic motor
20: Cab
21, 21A, 21B: Controller
22: Operation lever device
23: External input/output device
24: Boom angle sensor
25: Arm angle sensor
26: bucket angle sensor
27: Swing angular velocity sensor
28: Inclination angle sensor
30: Display screen
31: Numeric key
32: Threshold button
33: Determination mode button
34: Determination process start button
35: Load value display portion
36: Message display portion
37: Load true value setting button
38: Boom bottom pressure sensor
39: Boom rod pressure sensor
40: Graph display portion
41: Drop down list
50: Load value calculation section
51: Work arm tip position calculation section
52: Load threshold setting section
53, 53A: Load threshold changing section
54: Recalibration determination section
56: Work arm operation velocity calculation section
58: Load value decision section
59: Work arm tip position decision section
100: Hydraulic excavator

The invention claimed is:

1. A work machine comprising:

a machine body;

a front work implement that is an articulated type, is attached to the machine body, and includes a plurality of front members rotatably connected to each other;

a plurality of hydraulic actuators that respectively drive the plurality of front members of the front work implement in accordance with operation signals;

a load measuring system that includes a work load sensor detecting work loads of the hydraulic actuators, a plurality of posture information sensors detecting posture information that is information associated with respective postures of the plurality of front members and the machine body, and a controller calculating a load value as a weight of a transportation target carried by the front work implement based on detection results obtained by the work load sensor and the posture information sensors; and a display device disposed inside a cab boarded by an operator, wherein the controller is capable of changing a load threshold used for determining whether to recalibrate the load measuring system in accordance with a posture index value that is an index concerning a posture of the front work implement and obtained based on the detection results of the posture information sensors, and the controller determines whether to recalibrate the load measuring system based on a calculation result of the load value and the changed load threshold, and displays a determination result on the display device.

2. The work machine according to claim 1, wherein the controller calculates, as the posture index value of the front work implement, a position of a tip of the front work implement in a vehicle coordinate system set beforehand for the machine body, the position being calculated based on the detection results of the plurality of posture information sensors, and the controller changes the load threshold in accordance with the position of the tip of the front work implement, the position having been calculated as the posture index value.

3. The work machine according to claim 1, wherein the controller calculates, as the posture index value, a shift velocity of a tip of the front work implement in a vehicle coordinate system set beforehand for the machine body, the shift velocity being calculated based on the detection results of the plurality of posture information sensors, and the controller changes the load threshold in accordance with the shift velocity of the tip of the front work implement, the shift velocity having been calculated as the posture index value.

4. The work machine according to claim 1, wherein the controller selectively changes the load threshold to any one of a plurality of candidate values in accordance with the posture index value.

5. The work machine according to claim 1, wherein the controller changes the load threshold in accordance with the posture index value by determining the load threshold corresponding to the posture index value with reference to a load threshold table that continuously determines a relation between the posture index value and the load threshold.

6. The work machine according to claim 1, wherein the controller calculates an average of the posture index values in a period determined beforehand, and changes the load threshold in accordance with a calculation result of the average of the posture index values, and the controller calculates an average of the load values in a period determined beforehand, and determines whether to recalibrate the load measuring system based on a calculation result of the average of the load values and the changed load threshold.

7. The work machine according to claim 1, wherein the controller sets, as a load true value, a true value of a load value that is a weight of the transportation target carried by the front work implement, and the controller determines whether to recalibrate the load measuring system based on a difference between the load true value and the load value, and on the load threshold.

* * * * *